US008621668B1

(12) United States Patent
Nolz

(10) Patent No.: US 8,621,668 B1
(45) Date of Patent: Jan. 7, 2014

(54) CONVERTIBLE GARMENT

(75) Inventor: Jason Nolz, Manchester, IA (US)

(73) Assignee: Splitzgear, L.L.C., Manchester, IA (US)

( * ) Notice: Subject to any disclaimer, the term of this patent is extended or adjusted under 35 U.S.C. 154(b) by 48 days.

(21) Appl. No.: 13/474,381

(22) Filed: May 17, 2012

(51) Int. Cl.
*A42B 5/00* (2006.01)
*A42B 1/18* (2006.01)
*A42B 1/04* (2006.01)

(52) U.S. Cl.
USPC ..... 2/207; 2/206; 2/468; 2/209.11; 2/171.4; 2/173

(58) Field of Classification Search
None
See application file for complete search history.

(56) References Cited

U.S. PATENT DOCUMENTS 1,686,258 A * 10/1928 Schlesinger ..... 2/172
1,916,036 A * 6/1933 Boreham ..... 36/2 A
2,806,222 A * 9/1957 Carpenter ..... 2/91
2,839,757 A * 6/1958 Gianola ..... 2/205
2,998,611 A * 9/1961 Schuessler ..... 2/181.4
3,157,887 A * 11/1964 Rothstein ..... 2/203
3,237,210 A * 3/1966 Graber ..... 2/209.11
3,285,307 A * 11/1966 Dormaier ..... 383/4
3,449,766 A * 6/1969 Friedman et al. ..... 2/209.12
3,838,467 A * 10/1974 Zientara ..... 2/202
4,180,868 A * 1/1980 Snow ..... 2/203
4,593,417 A * 6/1986 Brown et al. ..... 2/172
4,641,380 A * 2/1987 Epstein ..... 2/209.11
5,007,115 A * 4/1991 Denbow et al. ..... 2/208
5,091,996 A * 3/1992 Kirby ..... 2/206
5,109,548 A * 5/1992 Balaban et al. ..... 2/173
5,115,517 A * 5/1992 Ferguson et al. ..... 2/203
5,251,336 A * 10/1993 Nevins ..... 2/202
5,309,574 A * 5/1994 Balaban et al. ..... 2/202
5,621,921 A * 4/1997 Outland ..... 2/207
5,704,068 A * 1/1998 Martin ..... 2/173
5,713,076 A * 2/1998 Davis ..... 2/4
5,765,230 A * 6/1998 Sivret et al. ..... 2/202
5,822,800 A * 10/1998 Anderson ..... 2/202
5,836,303 A * 11/1998 Hurst et al. ..... 128/206.24
5,960,478 A * 10/1999 Sivret et al. ..... 2/202
6,088,838 A * 7/2000 Sontag ..... 2/202
6,640,342 B2 * 11/2003 Dixon ..... 2/171
6,754,909 B1 * 6/2004 Samelian ..... 2/206
7,137,150 B2 * 11/2006 Larson ..... 2/202
7,152,252 B2 * 12/2006 Gellis et al. ..... 2/206
7,228,858 B2 * 6/2007 Baker ..... 128/201.22

(Continued)

OTHER PUBLICATIONS

Amazon.com, Super Morph Hat/Neck Gaiter, http://www.amazon.com/Super-Morph-Hat-Neck-Gaiter/dp/B0045DVJU8.

*Primary Examiner* — Bobby Muromoto, Jr.
(74) *Attorney, Agent, or Firm* — Allan L. Harms; Shuttleworth & Ingersoll, PLC

(57) ABSTRACT

A convertible winter garment converts from a cap or hat configuration to a neck gaiter, face cover, or hand warmer. The garment is a four-edged fabric with two layers such that opposing side edges of the fabric provide openings for insertion of the user's hands between the layers when the garment is used as a hand warmer. A transparent window through one layer of the garment permits observation of a mobile device held between the layers. Clips mounted along the edge opposing the longest edge can be attached to edges of the bill of a baseball cap worn by the user and anchor the garment to the baseball cap. In one embodiment, a bill having view openings is attached to the garment such that it can be used to shield the user's face from either overhead or below.

21 Claims, 25 Drawing Sheets

(56) References Cited

U.S. PATENT DOCUMENTS

| | | | | |
|---|---|---|---|---|
| 7,240,372 | B2 * | 7/2007 | Larson | 2/173 |
| D569,079 | S * | 5/2008 | Whong | D2/502 |
| 7,424,751 | B1 * | 9/2008 | Miller | 2/209.11 |
| 7,603,724 | B2 * | 10/2009 | Mickle | 2/173 |
| D609,427 | S * | 2/2010 | Wilson | D2/600 |
| 7,818,819 | B2 * | 10/2010 | Chiang | 2/206 |
| 8,161,575 | B2 * | 4/2012 | Debrick | 2/207 |
| 8,185,969 | B2 * | 5/2012 | Chang | 2/9 |
| 8,201,273 | B2 * | 6/2012 | Duncan | 2/202 |
| 2004/0098789 | A1 * | 5/2004 | Carey | 2/173 |
| 2005/0050612 | A1 * | 3/2005 | Larson | 2/203 |
| 2009/0276938 | A1 * | 11/2009 | Chiang | 2/206 |
| 2010/0064417 | A1 * | 3/2010 | Fruge | 2/202 |
| 2011/0185482 | A1 * | 8/2011 | Godfrey et al. | 2/424 |
| 2013/0180030 | A1 * | 7/2013 | Wilson | 2/207 |
| 2013/0180974 | A1 * | 7/2013 | Wilson | 219/211 |

* cited by examiner

CONVERTIBLE GARMENT

BACKGROUND

Many types of winter headgear exist, as do scarves, neck gaiters, balaclavas, gloves and hand warmers. Hats and caps are used atop the wearer's head while second and third garments are required when the user wishes to cover his or her face or neck and hands. A convertible garment would reduce the number of winter head and neck covering garments a person will need and would permit conversion of the garment into alternate configurations as needs and wishes dictate.

BRIEF SUMMARY OF THE INVENTION

The present invention presents a convertible garment which can be used as a cap or hat and which can be converted for use as a face covering, a neck gaiter, a hand warmer or a short cape. An embodiment is also disclosed which is particularly useful for game hunters who desire to cover as much of their skin as possible so that the game being hunted will not detect their presence.

The first embodiment of the invention provides a head covering which is designed to overlie a baseball cap or sun visor with a brim. The invention includes a flexible fabric body which may include dual layers and which when unfolded becomes a four-edged flexible body with opposing longer first and second edges and shorter side edges. The fabric body includes left and right portions which mirror each other and when unfolded and laid flat, the body resembles a butterfly's wings in shape. The body is narrowed along its centerline connecting the longer edges. The opposing shorter side edges of the fabric diverge as they approach their connections with the first edge of the fabric body. Closure elements which may be hook and loop fastener sets, or snaps, buttons, or lacing, are attached to the fabric along the first edge with one half of the first edge connecting with the other half of the first edge through use of the closure elements when the garment is to be used as a cap or hood. The second edge of the fabric body is slightly concave to allow observation of the signage on the front panel of a baseball cap worn under the garment.

In another embodiment the fabric body may include two layers so the opposing shorter edges of the fabric body may include hand openings between the layers. In addition, when used as a hand warmer, the invention may include a flexible transparent window or an opening which provides a view of the face or display of a mobile device such as a mobile phone or other personal electronic device thereby allowing manipulation of the controls of the electronic device for sending of text messages or looking for information accessible on the device.

Alternatively, the dual layer garment may include closable openings for the users' thumbs to pass through when the hands have been inserted between the layers of the garment so that an electronic device held exterior to the unfolded garment can be manipulated by the user's thumbs as is commonly done for text messaging or for operation of video games stored on the electronic device.

In yet another embodiment, the garment can be configured to include a bill which may be placed to extend from the user's forehead or which can be reconfigured to serve as a camouflaging shield for the user's face or as a spacer between the user's mouth and the garment when the embodiment is configured as a face covering.

It is a primary object of the invention to provide a versatile garment which may be converted from a cap configuration to a face shield or to a neck gaiter or to a hand warmer.

It is another objective of the invention to provide a hunter's garment which may be converted from cap to face shield and which includes a bill which may be used to shield the user's eyes and face from sunlight or as a shield to prevent game from seeing features of the face of the hunter or as a spacer to enhance breathability when the garment is configured as a face shield.

It is a further objective of the invention to provide a hand warmer with which a user can enjoy using a mobile device without removing his or her hands from the hand warmer.

These and other desirable objectives of the invention will be understood from examination of the detailed description and drawings.

DETAILED DESCRIPTION OF THE INVENTION

Figure 1A:
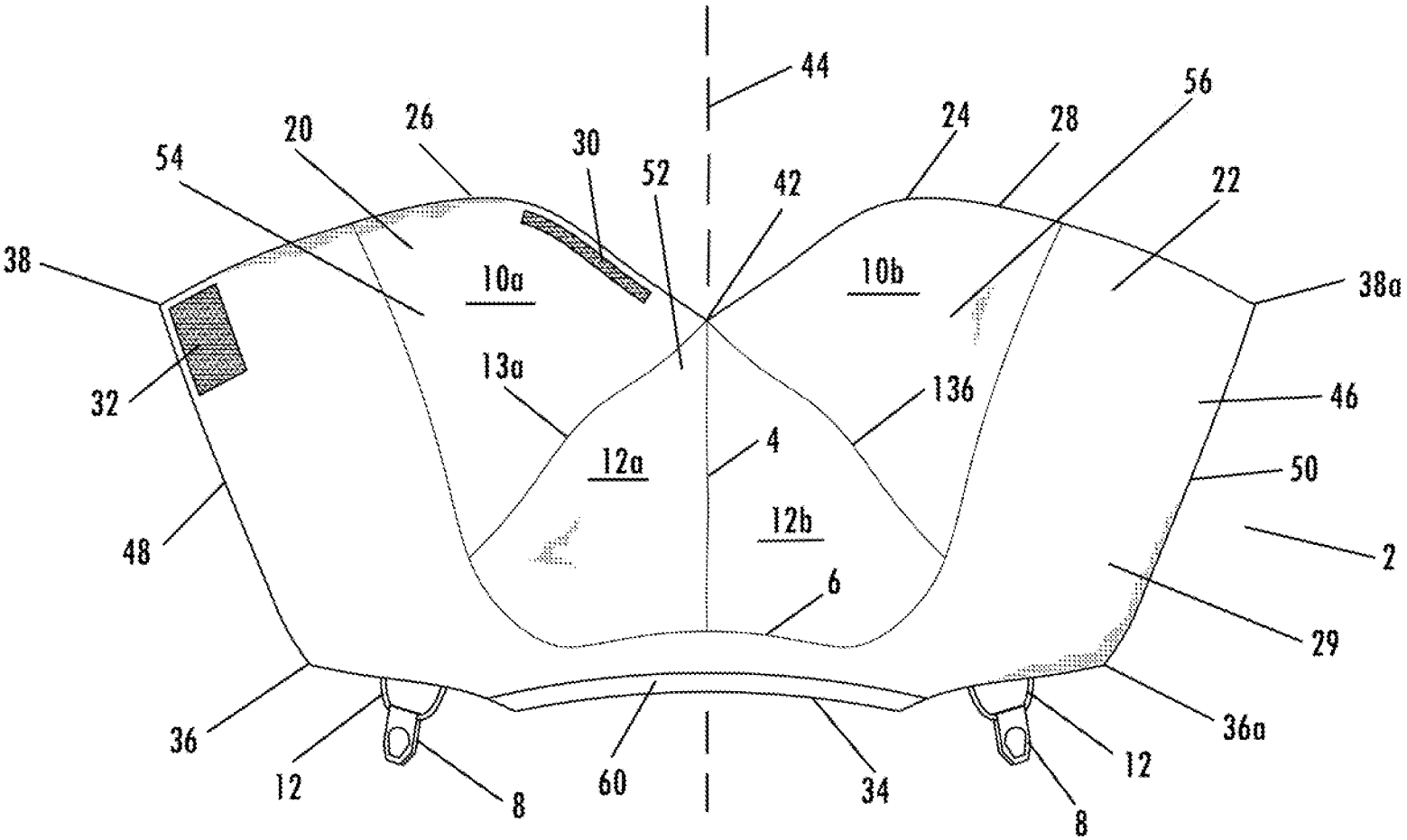
FIG. 1A is a top view of a first embodiment of the convertible garment according to the invention, in an unfolded, generally flattened configuration.

FIGS. 1A, 1B and 2-8 illustrate a first embodiment of the convertible garment 2. FIG. 1A shows the garment 2 unfolded into a flat fabric body 46 shaped somewhat like butterfly wings. Fabric body 46 includes a first edge 24 and an opposing second edge 34. Edges 24 and 34 are interconnected by side edges 48, 50. First and second edges 24, 34 are longer than side edges 48, 50 so that fabric body 46 has a longer dimension and a generally transverse shorter dimension. First edge 24 comprises a first segment 26 and an adjoining second segment 28 which meet endwise at center 42 of first edge 24.

Fabric body 46 is preferably flexible and includes a first portion 20 and a second portion 22, each of which is a mirror image of the other, the portions 20, 22 being symmetrical about an imaginary centerline 44 passing through the fabric body 46 where it narrows, the centerline being generally coincident with a centerline seam 4 of the garment 2. First portion 20 and second portion 22 are substantially equal in area.

Fabric body 46 may include the centerline seam 4 and side seams 13*a*, 13*b*, all of which converge and meet at center 42 of first edge 24. Centerline seam 4 and side seams 13*a*, 13*b* divide garment 2 into panels 10*a*, 10*b*, 12*a*, 12*b*, while a circumferential seam 6 defines circumferential panel 29 which adjoins panels 10*a*, 10*b*, 12*a*, 12*b*. The segmentation of fabric body 46 into panels 10*a*, 10*b*, 12*a*, 12*b* facilitates conformance of the garment 2 to the curvature of the typical user's head 3 as well as to permit garment 2 to surround a user's neck. If the fabrics used for garment 2 are sufficiently elastomeric, seams 4, 13*a*, 13*b*, and 6 may not be necessary. Fabric body 46 is widest near side edges 48, 50 and may be made from Polarfleece® material, flexible nylon fabric, wool and other typical clothing fabrics.

The opposing ends of second edge 34 and first edge 24 are joined by free side edges 48, 50 at first corners 36, 36*a* and second corners 38, 38*a*. Free side edges 48, 50 are generally equivalent in length and shorter than either first edge 24 or second edge 34.

Fasteners 30, 32 provide closures to selectively retain first segment 26 to second segment 28. First fastener 30 may be one part of a fastener pair (such as a hook and loop fastener) which may detachably fasten to a complementary second part 30*a* (See FIG. 5) attached to the reverse surface of fabric body 46. Similarly, second fastener 32 can be one element of a fastener pair which may detachably fasten to a complementary second part 32*a* on the reverse surface of the fabric body 46 (See FIG. 5). A second fastener 30 may not always be required to hold first segment 26 adjacent to second segment 28.

In FIG. 1A, first edge 24 may be observed to converge toward second edge 34 as first edge 24 approaches centerline 44, making fabric body 46 narrowest generally about its imaginary centerline 44. Each of first segment 26 and second segment 28 of first edge 24 curves away from center 42 to make each segment 26, 28 slightly convex. It is important that the distance between first edge 24 and second edge 34 be least in the central region 52 which adjoins imaginary centerline 44 on either side thereof. Preferably fabric body 46 is narrowest between first edge 24 and second edge 34 along imaginary centerline 44. On either side of central region 52 are distal regions 54, 56 of fabric body 46, the distal regions 54, 56 comprising most of first and second portions 20, 22 respectively and which extend from central region 52 to side edges 48, 50.

Figure 1B:
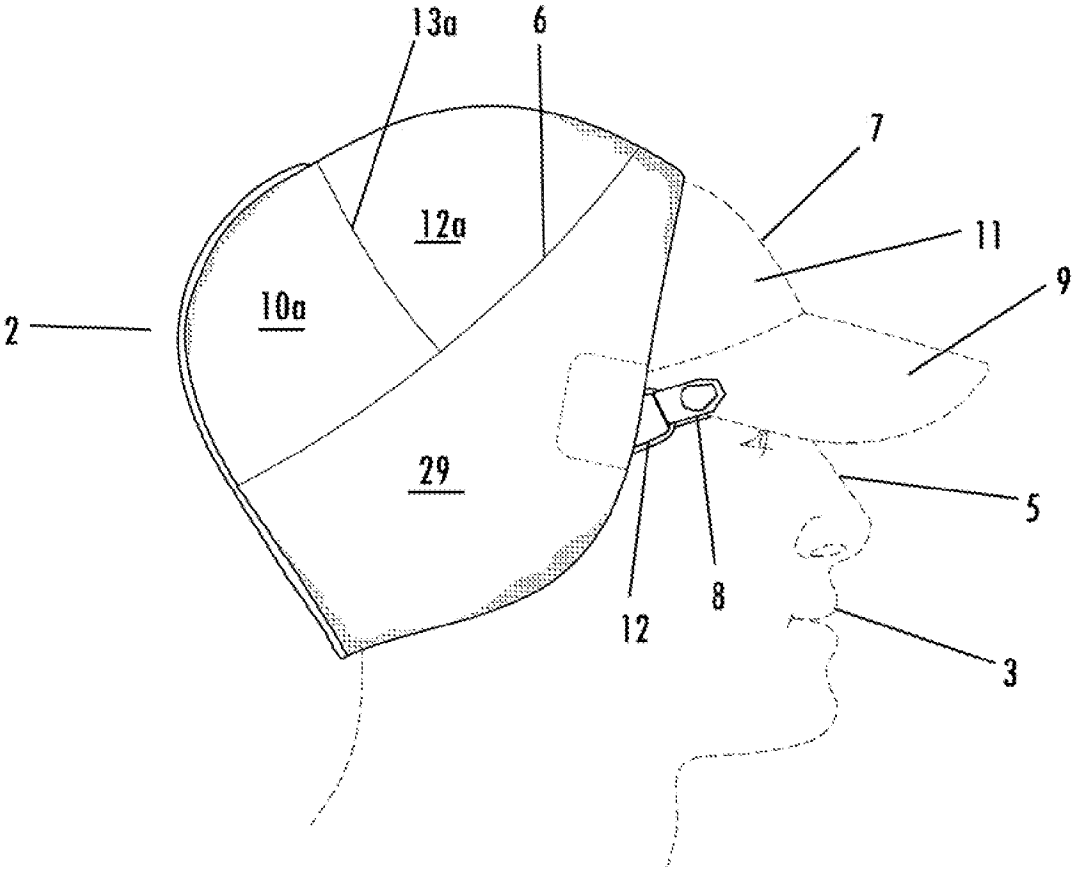
FIG. 1B is a side view of the first embodiment in its configuration as headgear worn on the head of a user.
Figure 3:
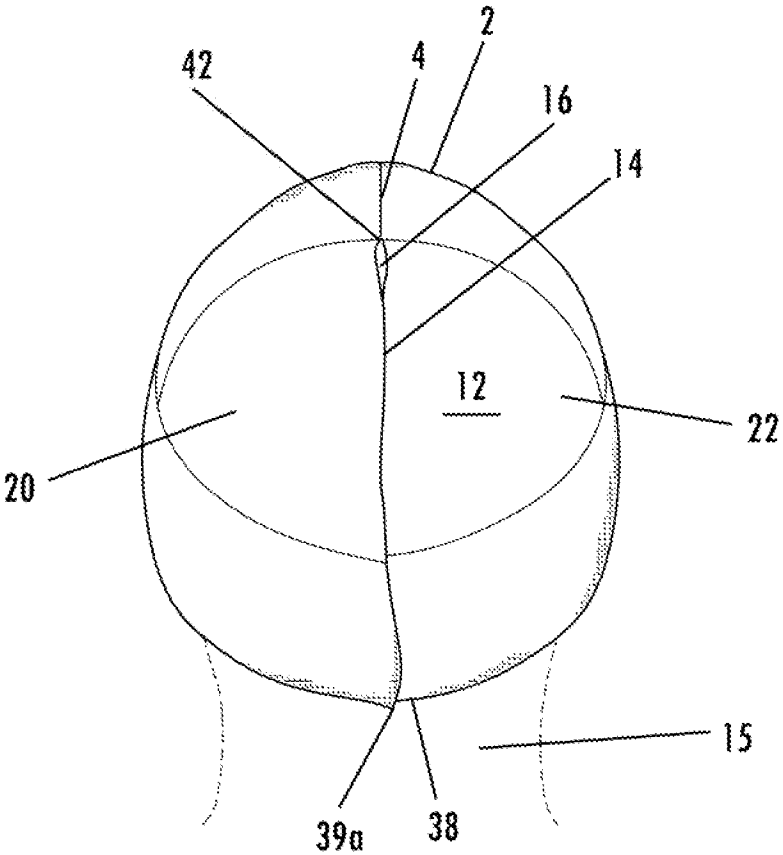
FIG. 3 is a rear elevation of the invention headgear of FIG. 1B.
Figure 2:
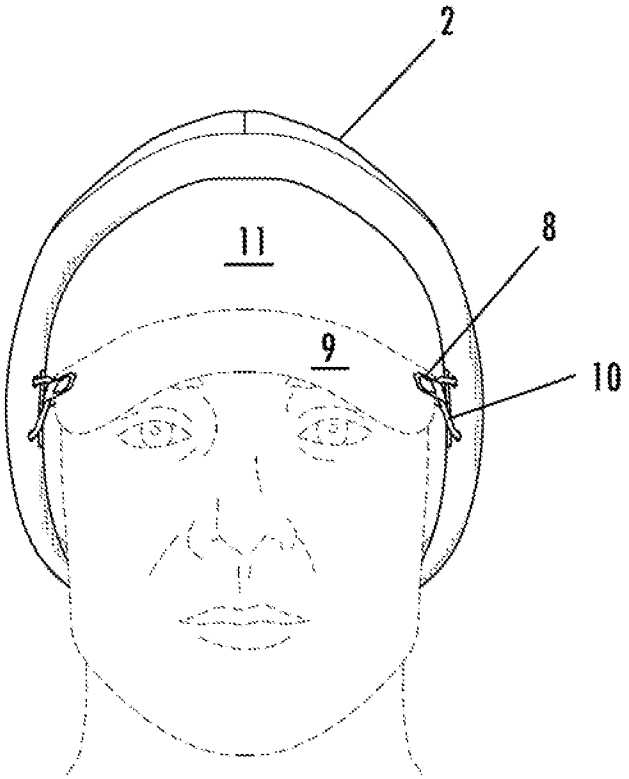
FIG. 2 is a front elevation of the invention headgear of FIG. 1B.

Second edge 34 may include a central slightly stiffened hem 60, the hem 60 facilitating the second edge 34 to create a frame for the front display panel 11 of a baseball cap 7 worn under the garment 2 when garment 2 is configured as a cap as illustrated in FIGS. 1B, 2, and 3. Optional clips 8 for attachment to the bill 9 of a baseball cap 7 are retained to second edge 34 and are spaced apart around centerline 44 approximately the width of a bill of a baseball cap. Clips 8 are joined to garment 2 by extenders or loops 12 which may be constructed of elastic cord. Clips 8 are preferably of a variety which will frictionally grip a thin object such as the bill 9 of the baseball cap 7 but yet can be detached by manipulation without the use of tools. Clips 8 may be temporarily stored in pockets which may be attached to or formed in fabric body 46 near second edge 34 thereof.

In order to configure garment 2 as a head covering or cap, first segment 26 of first edge 24 may be moved into side by side relationship or into a slight overlap with second segment 28 of first edge 24 by folding fabric body 46 about center 42 of first edge 24, with first segment 26 becoming removably attached to second segment 28, thereby creating closeable seam 14 as seen in FIG. 3.

Referring particularly to FIGS. 1B, 2-3, first embodiment garment 2 is shown in place on the head 3 of a user who is wearing a billed cap such as a baseball cap 7 having a bill 9. The garment 2 overlies part of the front panel 11 of the cap 7 as well as most of the side and rear panels (not visible) of the baseball cap, allowing signage on the front panel 11 to be observable and the bill 9 to be employed in the usual way for shielding the face 5 of the user from overhead sunlight.

Referring now particularly to FIG. 3, it can be seen that garment 2 is provided with a closable seam 14 which is selectively closed by hook and loop fasteners 30, 32 or by other suitable fasteners such as snaps, hooks, a zipper, buttons or by lacing or a drawstring. Closable seam 14 extends from the center 42 of first edge 24 of the garment 2 to corners 38, 38*a*. Closable seam 14 joins first portion 20 of garment 2 to second portion 22 thereof when garment 2 is configured as a cap as in FIGS. 1-3. An insignificant gap 16 along closable seam 14 may result from removable attachment of the first segment 26 to second segment 28, depending on quantity and placement of fasteners 30, 32.

Figure 4:
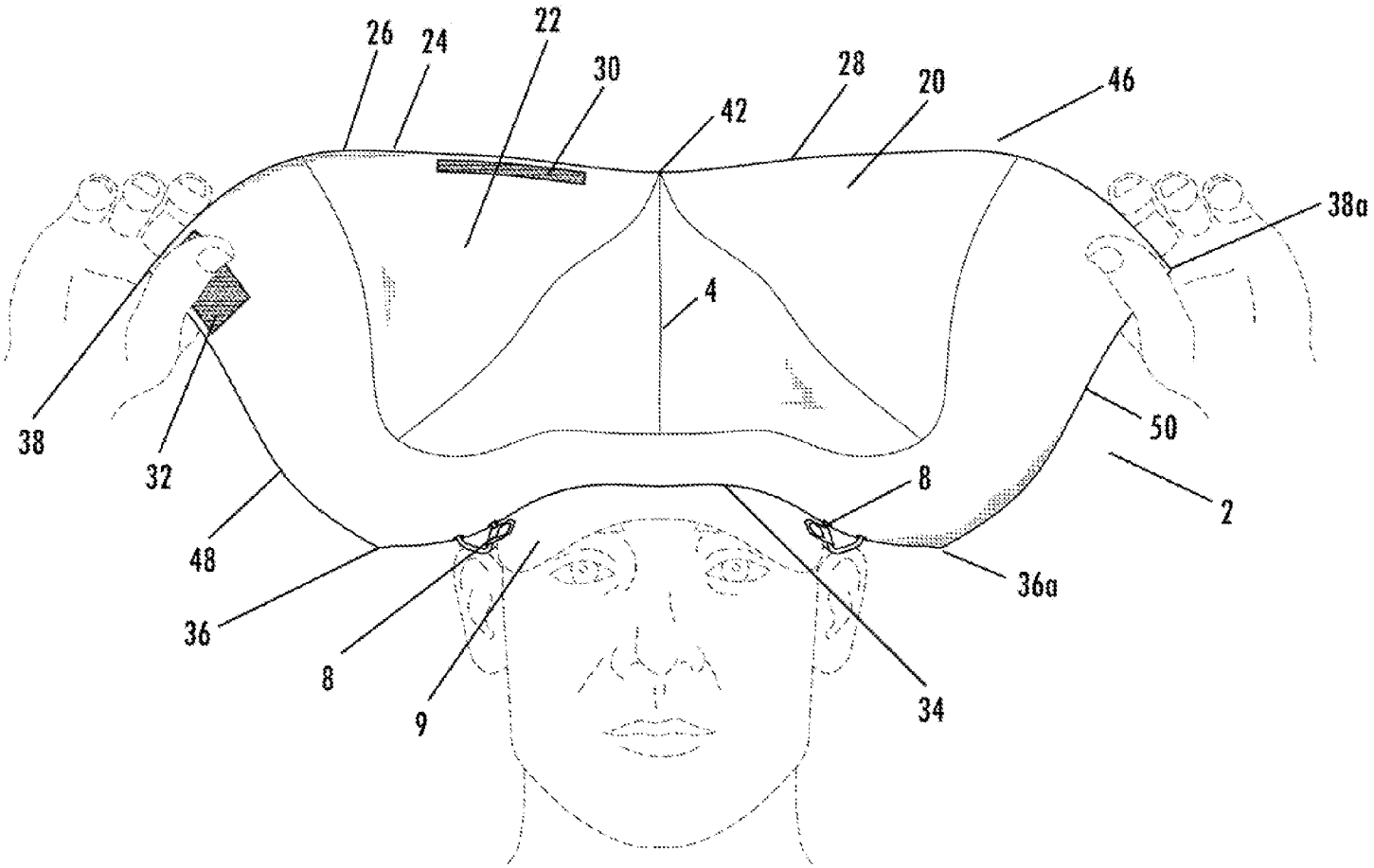
FIG. 4 is a front perspective of the garment in a first intermediate stage of conversion from headgear'to face cover.
Figure 7:
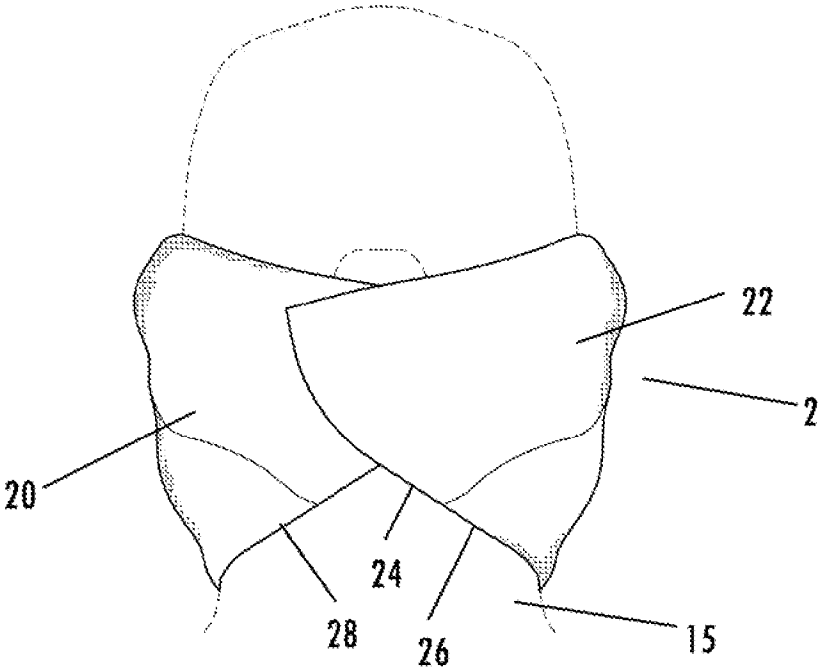
FIG. 7 is a rear view of the first embodiment of the invention in use as a face and neck covering.
Figure 6:
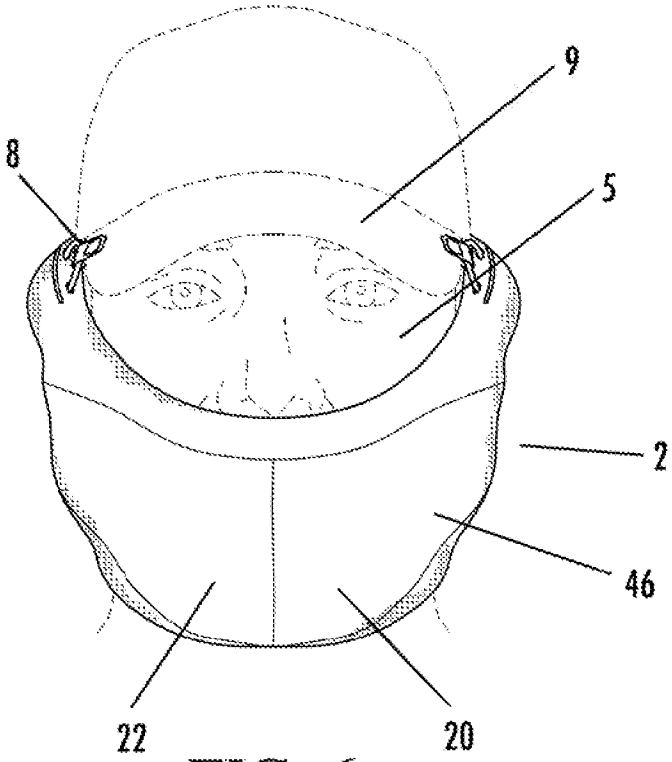
FIG. 6 is a front view of the first embodiment of the invention in use as a face and neck covering.

Referring additionally to FIG. 4, garment 2 is shown in a first transition step in reconfiguring garment 2 from a cap as in FIGS. 1A, 2, 3 to a face cover seen in FIGS. 6, 7.

Fasteners 30, 32 provide closures to selectively retain first segment 26 of first edge 24 to second segment 28 thereof. First fastener 30 may be one part of a fastener pair (such as a hook and loop fastener) which may detachably fasten to a complementary second part 30*a* (See FIG. 5) attached to the reverse surface of fabric body 46. Similarly, second fastener 32 can be one element of a fastener pair which may detachably fasten to a complementary second part 32*a* on the reverse surface of the fabric body 46 (See FIG. 5).

First fasteners 30, 30*a*, when interconnected may be used to narrow or close a gap 16 (See. FIG. 3) between first segment 26 and second segment 28 while second fasteners 32, 32*a* maintain the second corners 38, 38*a* in an overlapping, detachably connected arrangement. Use of second fasteners 32, 32*a* alone may be sufficient to reduce any gap 16 between first segment 26 of and second segment 28 to an acceptable minimum.

Clips 8 are retained to garment 2 inboard from first corners 36, 36*a* and spaced apart an amount approximately the width of the bill 9 of the baseball cap 7 worn by the user. Small sewn-in pockets (not shown) may be included on fabric body 46 to store clips 8 when they are not in use.

Figure 5:
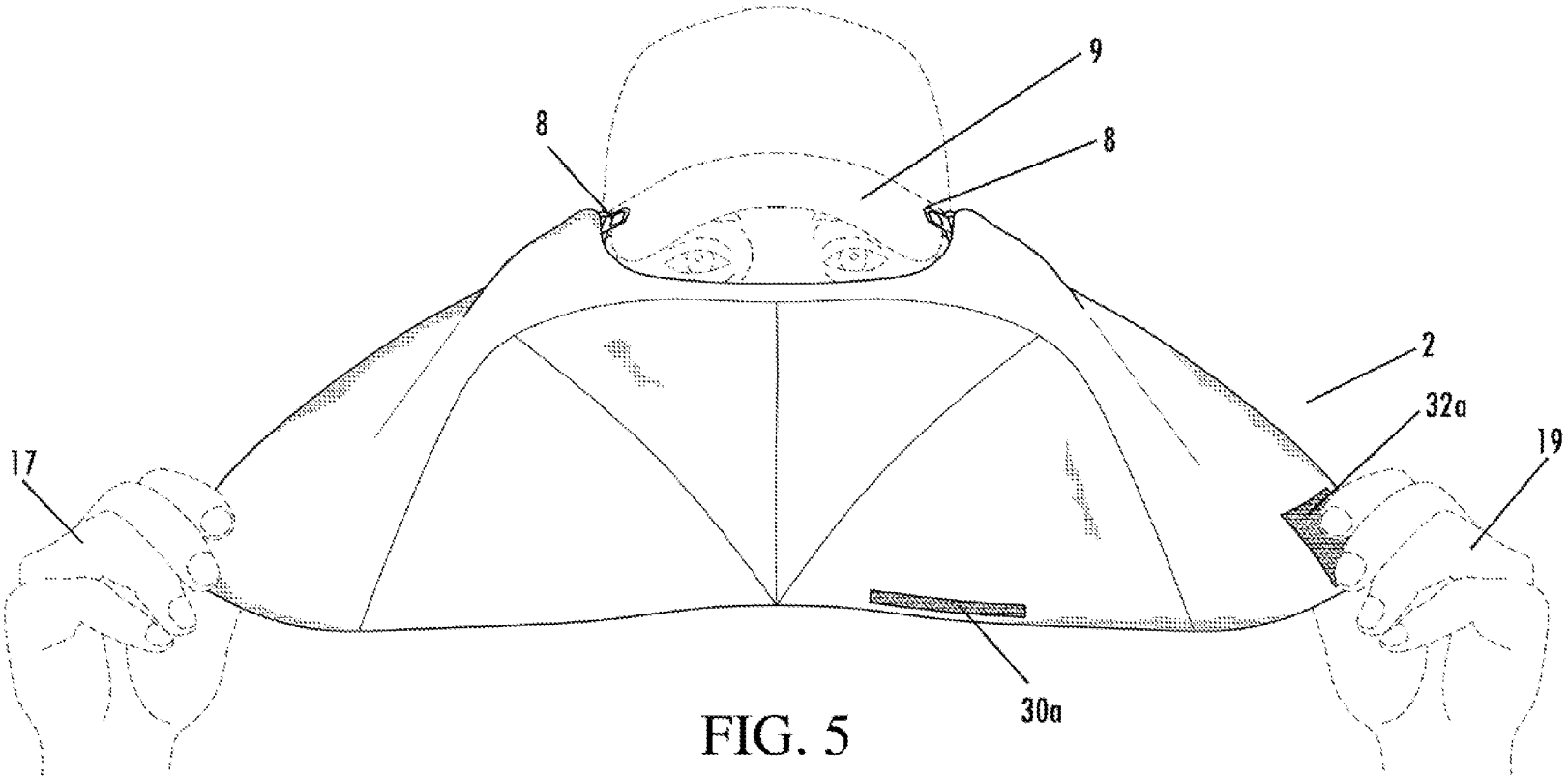
FIG. 5 is a front perspective of the garment in a second intermediate stage of conversion from head gear to face cover, the user having rotated the garment around the clips 8 thereof.
Figure 8:
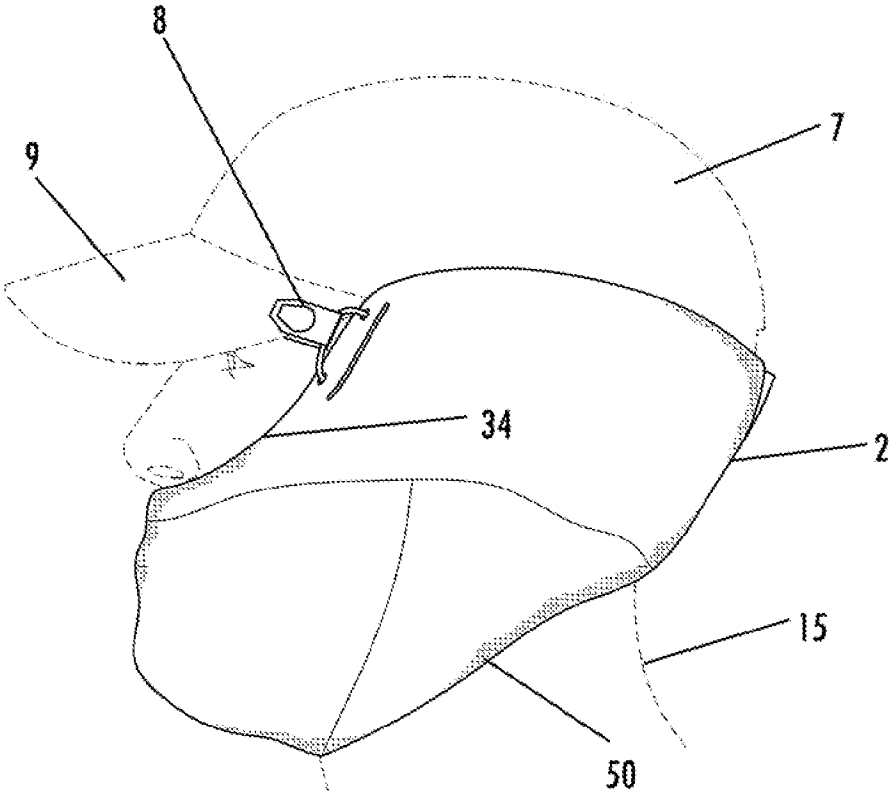
FIG. 8 is a side view of the invention in use as a face and neck covering.

In FIG. 5, one sees that garment 2 has been rotated about the attachment of clips 8 to bill 9, and placed below bill 9 such that garment 2 covers the nose, mouth and lower face of the user whose hands 17, 19 are used to effectuate the transformation of garment 2 from a cap to a face shield as illustrated in FIGS. 6-8.

FIGS. 6-8 illustrate the garment 2 converted to a fate shield while garment 2 remains attached by clips 8 to bill 9. The first and second portions 20, 22 of fabric body 46 now enclose opposing sides of the lower portion of the face 5 of the user, in condition to protect the mouth, jaw, and ears of the user from winter conditions or to obscure those facial features when certain game hunting activities prescribe camouflaging the user's skin. In FIG. 7, it can be seen that first and second segments 26, 28 of first edge 24 are now positioned at the nape 15 and are secured together by detachable closures, for example second fasteners 32, 32*a* seen in FIGS. 4-5. In the side view of FIG. 8, it can be seen that second free edge 50 extends along the neck of the user to the user's nape 15 while second edge 34 frames the uncovered part of the user's face and extends around the head of the user, while the garment 2 cooperates with baseball cap 7 to cover the user's head.

Figure 9:
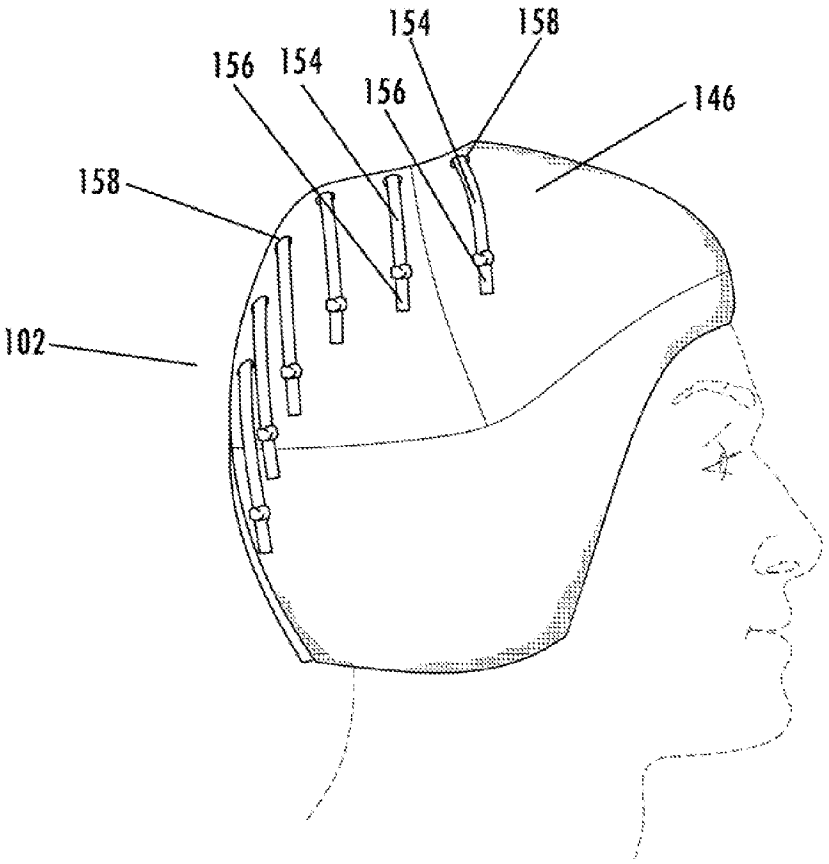
FIG. 9 is a side view of a second embodiment of the invention in place on the head of a user.
Figure 11:
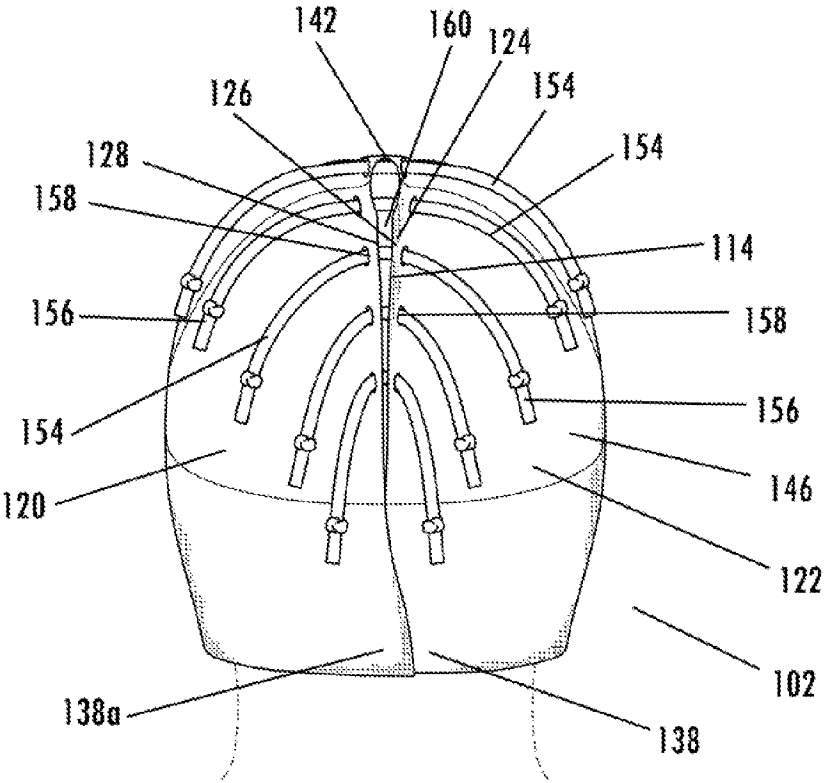
FIG. 11 is a rear view of the second embodiment of the invention in place on the head of a user.
Figure 10:
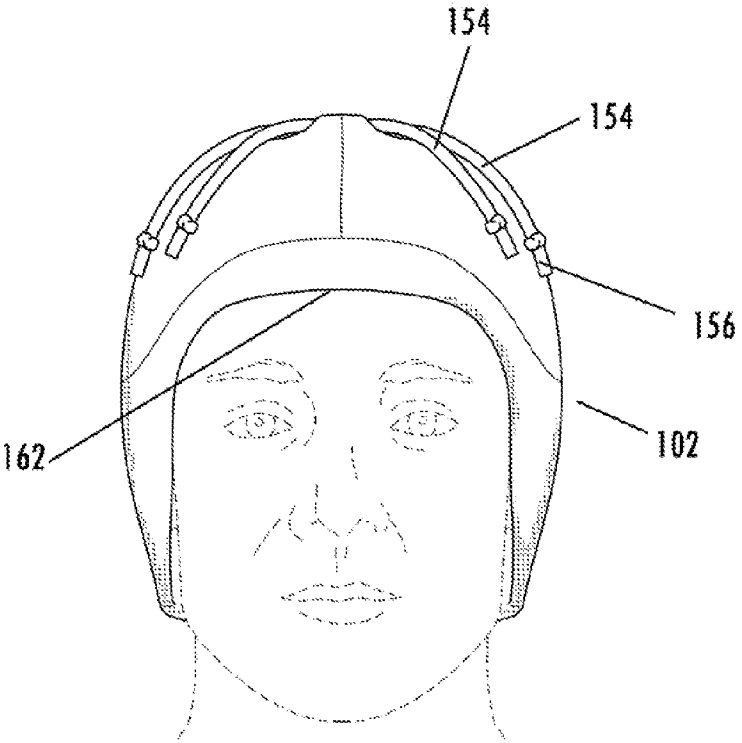
FIG. 10 is a front view of the second embodiment of the invention in place on the head of a user.

FIGS. 9-13 depict a second embodiment, namely garment 102. This embodiment nonetheless shares central features with the embodiment of FIGS. 1A-8. In FIGS. 9-11, second embodiment garment 102 is configured as a cap. A plurality of cords or laces 154 interconnect first half 120 of fabric body 146 to second half 122 thereof. Laces 154 pass through lace openings 158 which may be arranged to oppose so that the openings 158 of first half 120 align generally with the lace openings 158 of second half 122. First segment 126 and second segment 128 of the first edges 124 are drawn together by laces 154 when the user pulls on the free ends 156 of each lace 154 at generally the same time. A small elongate gap 160 may exist between the first segment 126 and second segment 128. Lace openings 158 permit the laces 154 to be laced such that a lace 154 passes through aligned lace openings 158. However, laces 154 may be installed such that a given lace 154 passes between non-aligned lace openings 156. Lace openings 156 are formed on fabric body 146 along first and second segments 126, 128 of first edge 124 from near the midpoint 142 at least a majority of the length of first and second segments 126, 128. Corners 138, 138*a* overlap and are held removably attached in that condition by closure elements such as hook and loop fasteners, clips, a zipper, buttons or equivalents thereto. Laces 154 maintain tension on opposing first and second segments 126, 128 by friction between them and lace openings 158.

Figure 13:
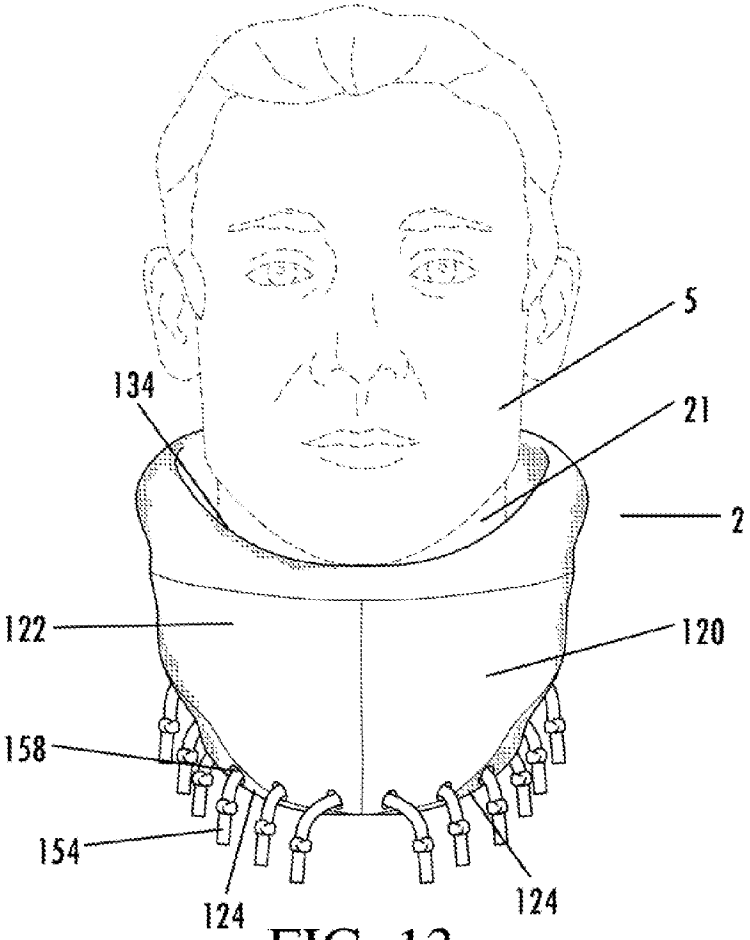
FIG. 13 is a front view of the second embodiment of FIG. 9 after its conversion to a neck gaiter.
Figure 12:
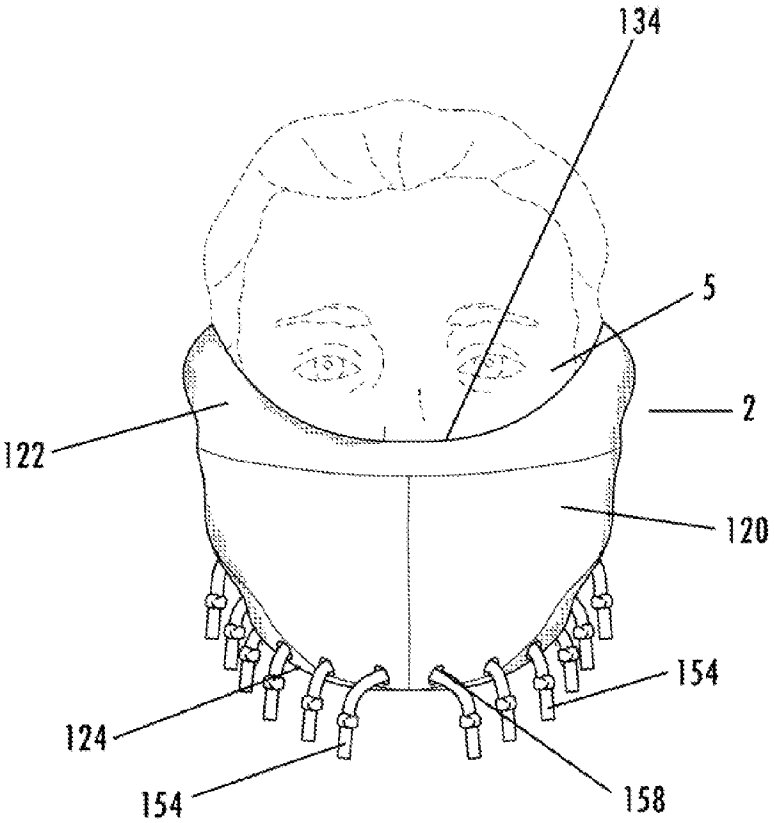
FIG. 12 is a front view of the second embodiment of the invention of FIG. 9 shown in place after conversion to a face covering.

From examination of FIGS. 12 and 13, it can be seen that garment 102 can be relocated about the face 5 or about the neck 21 of the user. To effect the relocation, garment 102 is pulled away from the user's head 103 such that gap 160 widens and the hook and loop fasteners or other closure elements which retain corners 138, 138*a* in overlap are disconnected, resulting in first segment 126 of first edge 124 becoming fully separated from second segment 128 thereof. Garment 102 may then be placed about the lower area of the face 5 by inverting the garment 102 such that its first edge 124 is oriented at the bottom of garment 102 and second edge 134 is oriented at the top when garment 102 is converted to a face cover as seen in FIG. 12 or configured as a neck gaiter as in FIG. 13. Therefore, laces 154 loosen as they are drawn into lace opening 158 as gap 160 is increased (See. FIG. 11) and as corners 138, 138*a* of the respective halves 120, 122 are separated. Garment 102 can then be wrapped around the face 5 or neck 21 of the user and corners 136 may again be joined by detachable fasteners, carried on the corners 138, 138*a* of the fabric body.

Figure 14:
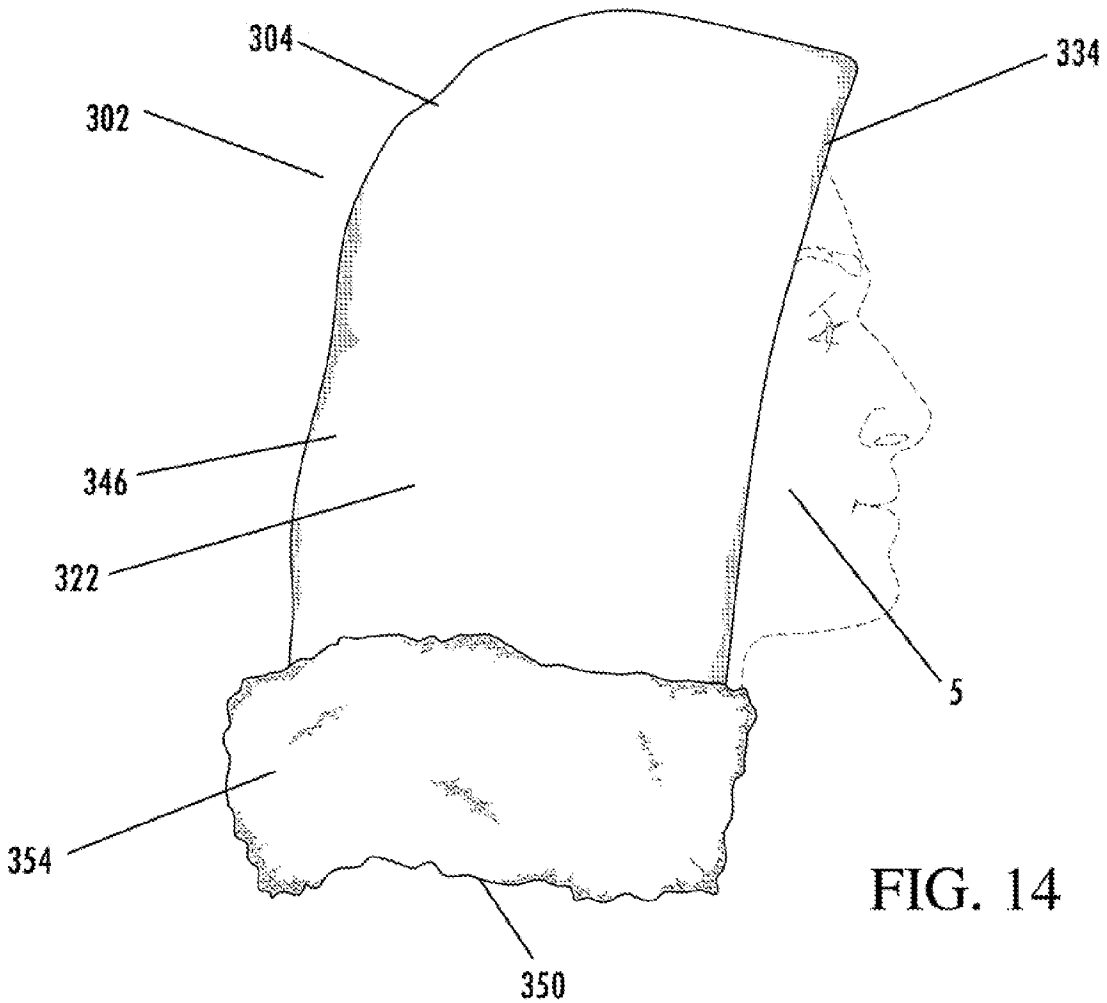
FIG. 14 is a side view of a third embodiment of the invention configured as a detached hood and shown on the head of a user.
Figure 15:
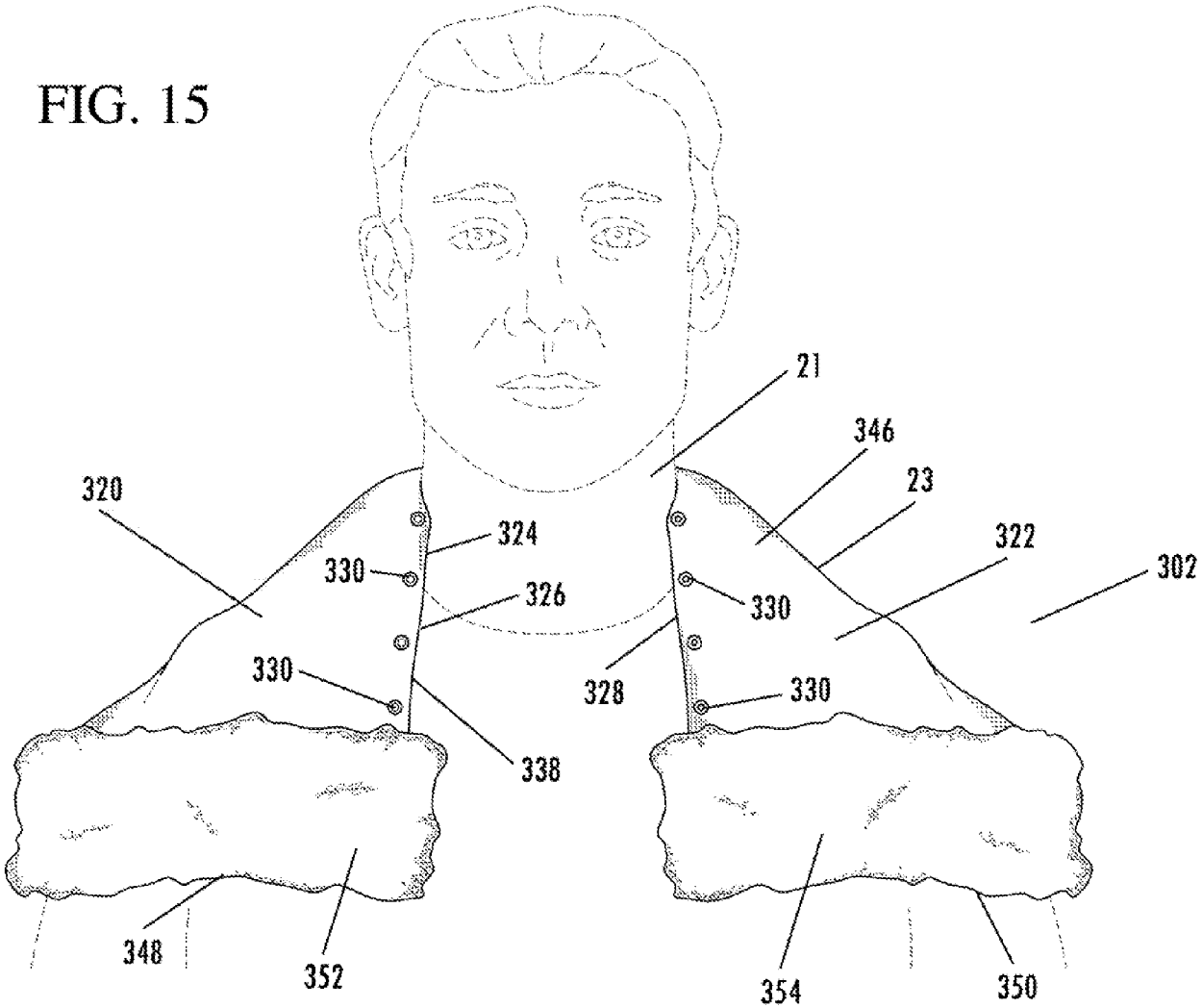
FIG. 15 is a front view of a user wearing the third embodiment configured as a shoulder covering.

Referring now to FIGS. 14-15, a third embodiment of the invention is seen. Garment 302 comprises a fabric panel 346 trimmed with fur strips 352, 354 attached to each of opposing free edges 348, 350. Fabric panel 346 includes first region 320 and second region 322, both of which are generally concave. First edge 324 is divided into substantially equal length first and second segments 326, 328 respectively. First and second segments 326, 328 of first edge 324 include complementary closure devices 330 which may be snap fasteners 330 or buttons or hook and loop fasteners so that when desired, first and second segments 326, 328 may be joined in a slightly overlapping fashion, the fabric panel 346 then being useful as a hood as illustrated in FIG. 14.

Second edge 334 of panel 346 opposes first edge 324 and frames the face 5 of the user when garment 302 is used as a hood. In the configuration of FIG. 15, panel 346 lies on the user's shoulders with first edge 324 lying beside the neck 21 of the user. For an alternative means of selectively retaining first segment 326 of first edge 324 to second segment 328 thereof, a hollow seam passageway may be formed along first edge 324 for receiving a drawstring. The drawstring can be drawn taut to draw first segment 326 alongside second segment 328 when the garment 302 is used as a hood as seen in FIG. 14, the first segment and second segments 326, 328 being positioned at the rear of the user's head and the gap between them being reduced by pulling on the drawstring.

Figure 16:
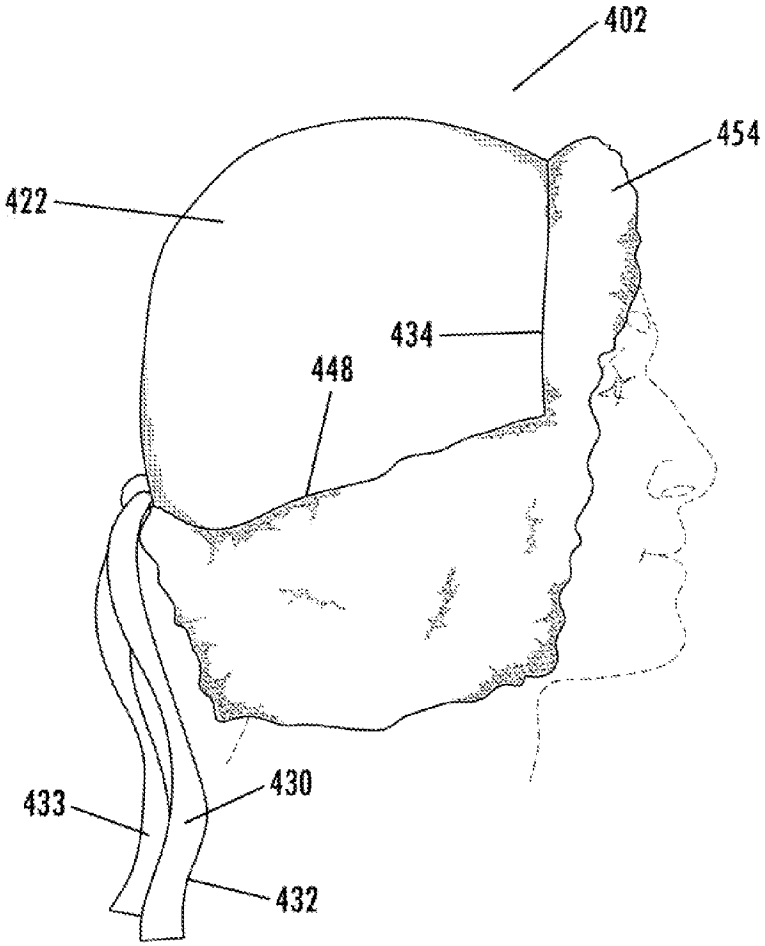
FIG. 16 is a side view of a fourth embodiment of the invention configured as a cap and shown in place on the head of a user.
Figure 17A:
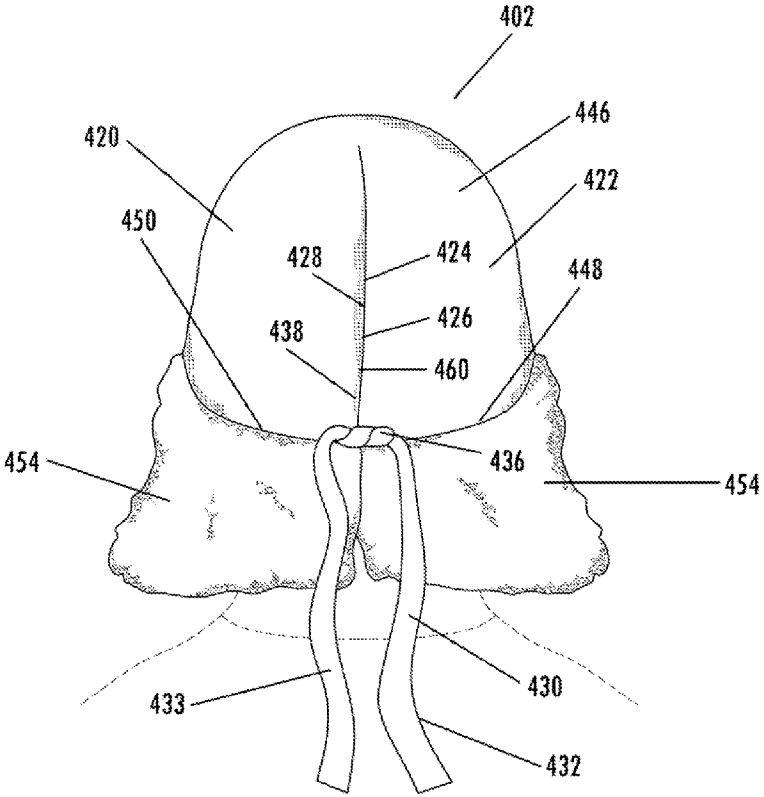
FIG. 17A is a rear view of the fourth embodiment of the invention shown in FIG. 16.
Figure 17B:
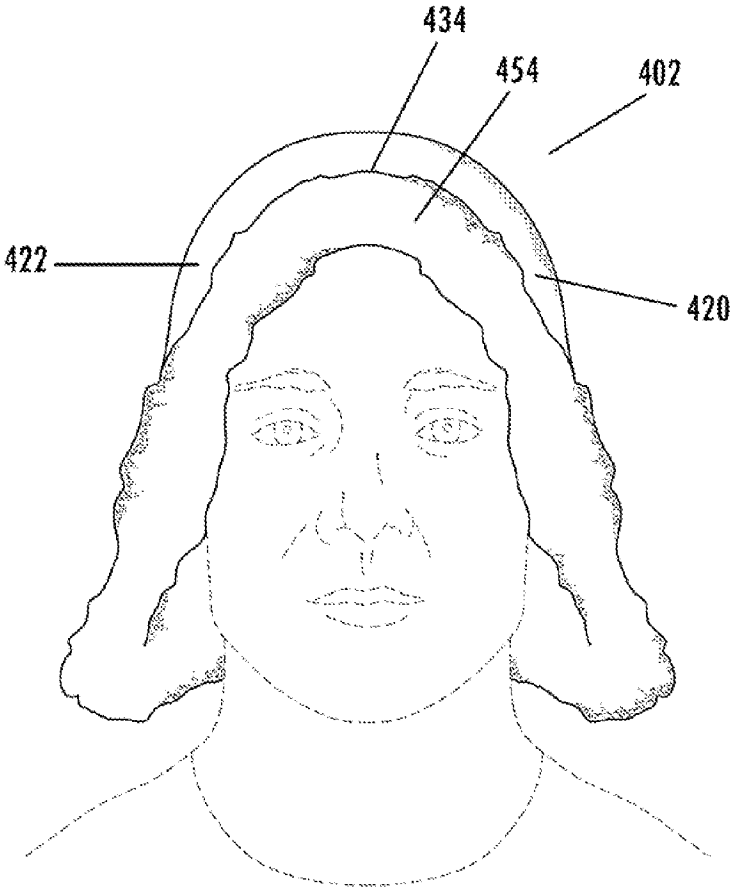
FIG. 17B is a front view of the fourth embodiment of the invention shown in FIG. 16.
Figure 18:
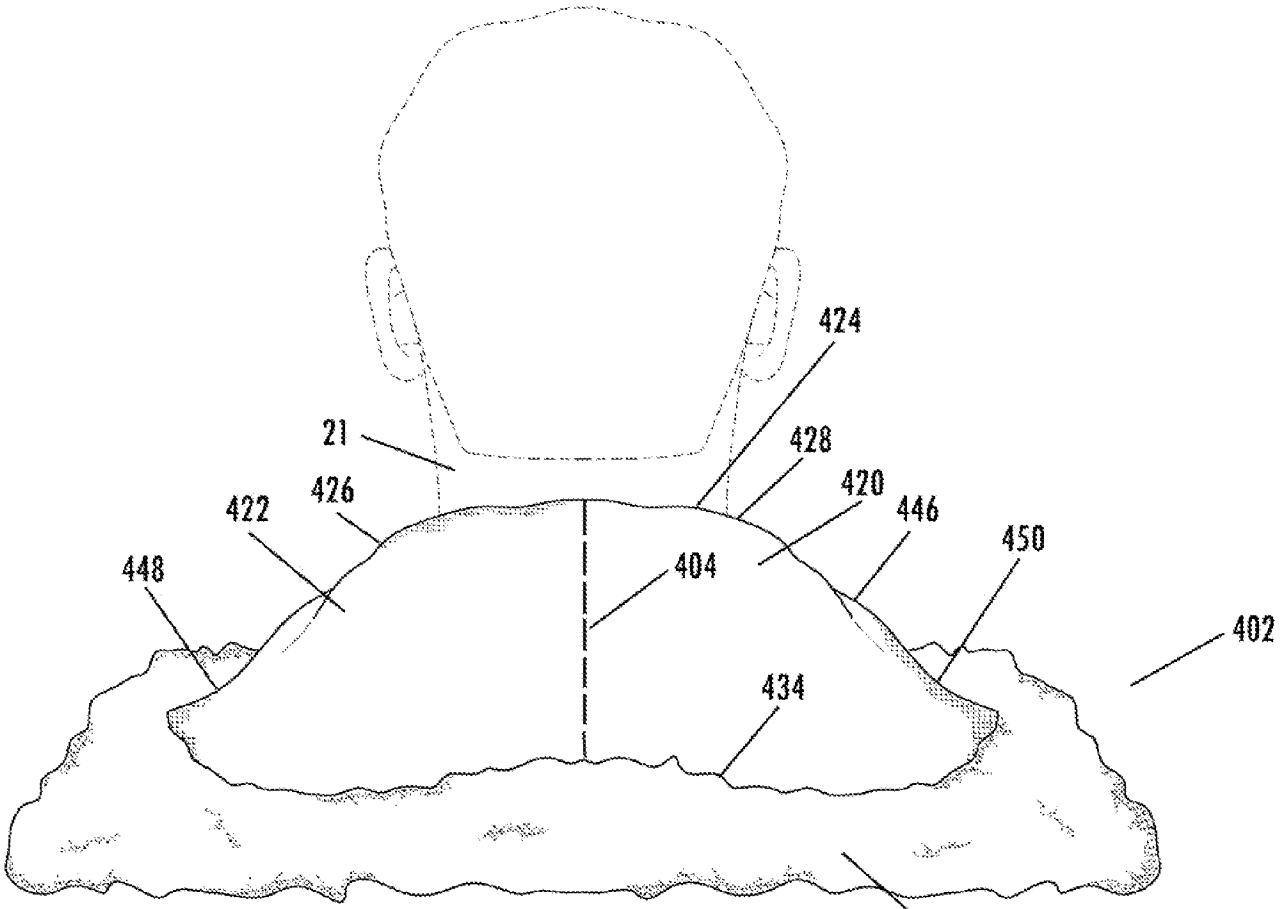
FIG. 18 is a rear view of a user using the fourth embodiment of FIG. 16 as a cape.
Figure 26:
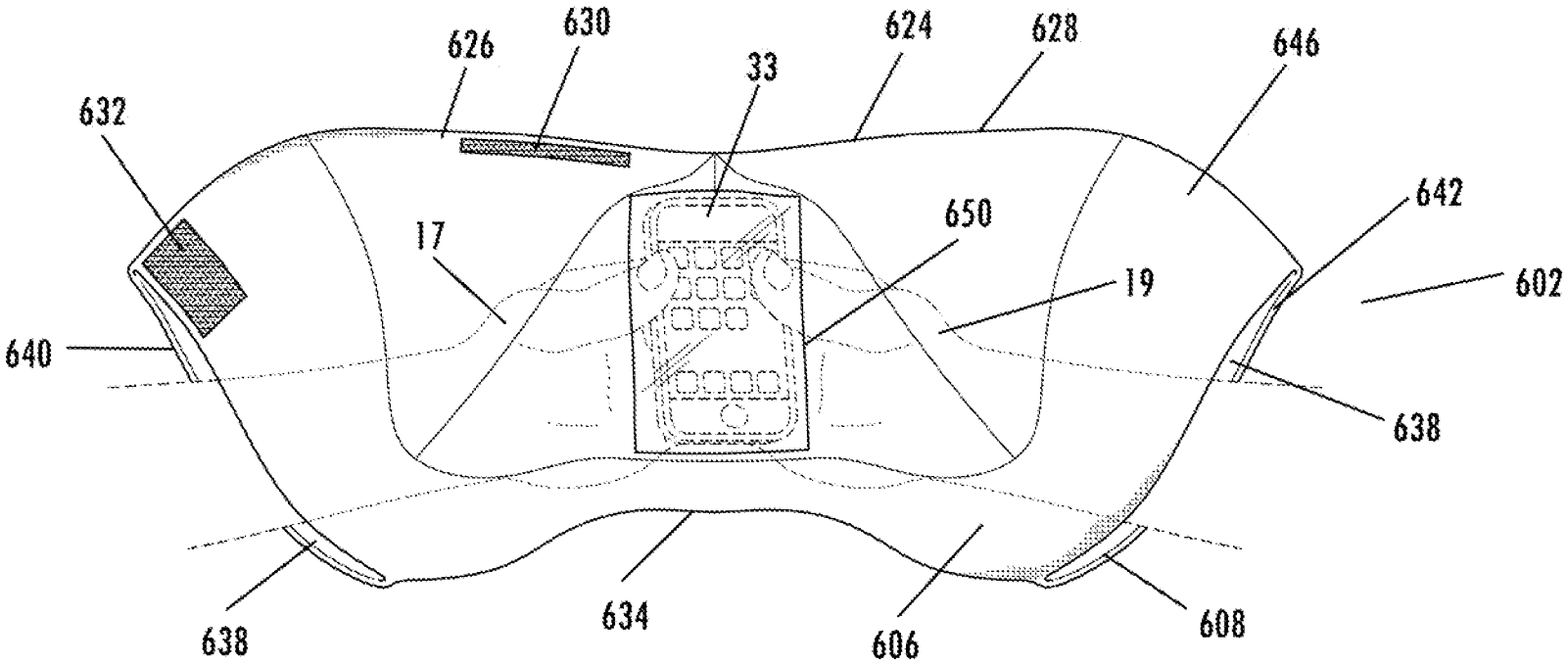
FIG. 26 is a front elevation of a sixth embodiment of the invention shown unfolded and in use as a hand warmer permitting use of a mobile device being held within the sixth embodiment.
Figure 27:
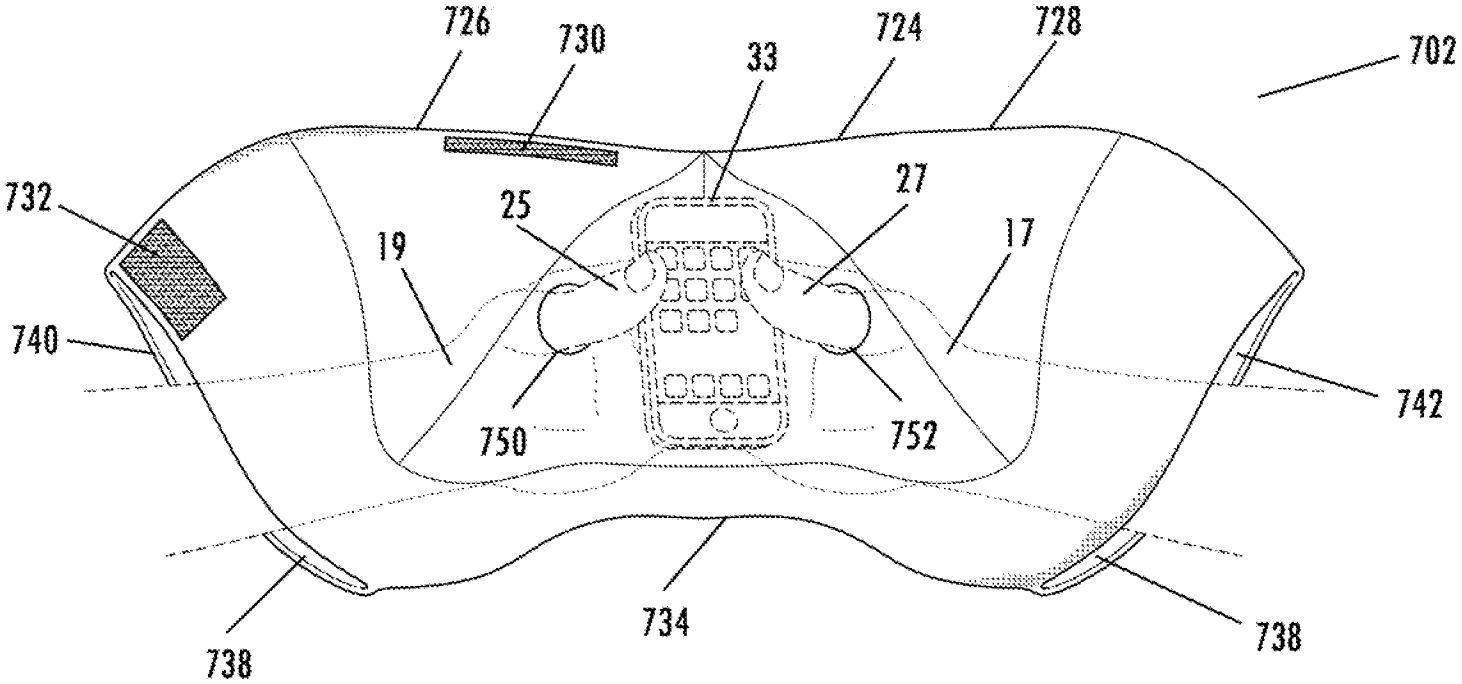
FIG. 27 is a front elevation of a seventh embodiment of the invention shown unfolded and in use as a hand warmer.

Referring to FIGS. 16-18, a fourth embodiment of the invention is shown which shares many features in common with the first, second and third embodiments described earlier. Garment 402 can be configured as a cap as in FIGS. 16 and 17 and as a cape in FIG. 18, in addition to being configurable as a fanny cover or apron tied about the user's waist or also alternatively as a hand warmer, such as is illustrated by the embodiments of FIGS. 26 and 27.

Garment 402 comprises a first portion 420 which is generally equivalent in area to second portion 422. Both first portion 420 and second portion 422 are necessarily concave (convex if viewed from the opposing side), or at least flexible enough to become concave, in order to conform to the head of a user. When configured as a cap as seen in FIGS. 16 and 17, fabric body 446 includes a first edge 424 which is divided into roughly equal first and second segments 426, 428 which may be drawn into proximity by drawstring 430 which is threaded through a seam passageway 438 sewn into or otherwise formed along the entire length of first edge 424. Therefore, drawstring 430 may be used to draw first segment 426 and second segment 428 together when the user pulls on string ends 432, 433. After pulling the drawstring 430 sufficiently snug to narrow any gap between first and second segments 426, 428, the user may tie ends 432, 433 together in a shoelace knot or other knot to prevent separation of first segment 426 from second segment 428.

As can be seen in FIGS. 16-18, fur trim 454 may be attached to fabric body 446 along second edge 434. Because second edge 434 opposes first edge 424 on fabric body 446, when drawstring 430 is unleashed, fabric body 446 may be spread to a generally flat configuration. It is important to note that fabric body 446 is at least four-sided with first edge 424 and second edge 434 each being longer than opposing side edges 448, 450. Each side edge 448, 450 may be adorned with fur trim 454 as well, to make a cold weather cap.

It is important to understand that fabric body 446 must slightly narrow as it approaches its imaginary midline 404 from opposing side edges 448, 450. No seam must necessarily follow imaginary midline 404. Fabric body 446 is therefore widest at opposing side edges 448, 450, with first portion 420 being substantially a mirror image of second portion 422.

Garment 402 is shown in its unfolded configuration in FIG. 18 where garment 402 is shown in use as a short cape with first edge 424 adjacent the user's neck 21. The drawstring 430 (not visible in FIG. 18) can be used to tie garment 402 at the front of the user.

Garment 402, when spread as seen in FIG. 18 may be used as an apron or carried as a fanny pack with drawstring 430 tied about the user's waist and fabric body 446 suspended below the user's waist. In addition, with the addition of appropriate fastening elements, garment 402, in the configuration illustrated in FIG. 18, could be detachably fastened to a coat to provide a decorative or functional collar or as a hood attachment, with the garment 402 being easily detachably from the coat so that it could be used in another configuration as illustrated in this disclosure.

Figure 23:
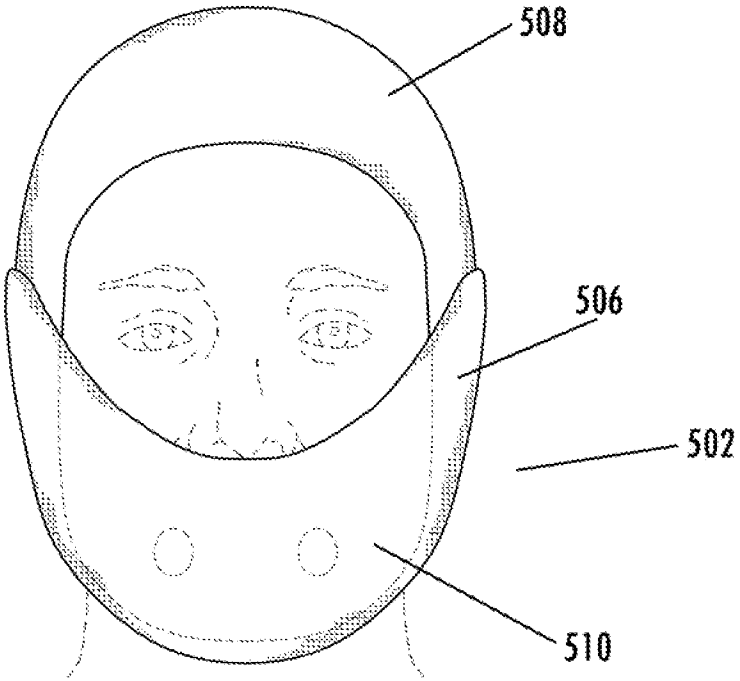
FIG. 23 is a front view of a user wearing the embodiment of FIG. 19 as a face covering with the bill of the embodiment tucked inside.
Figure 24:
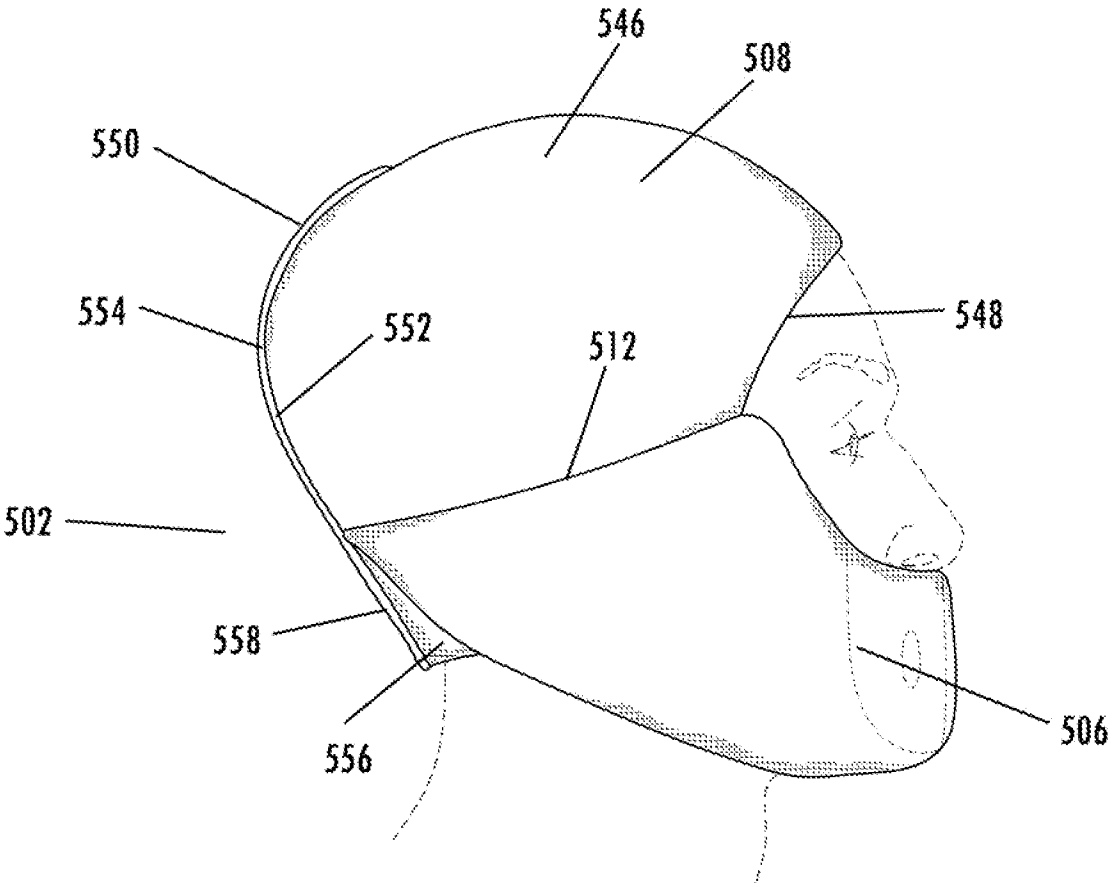
FIG. 24 is a side view of the embodiment of FIG. 19 as employed in FIG. 23.
Figure 25:
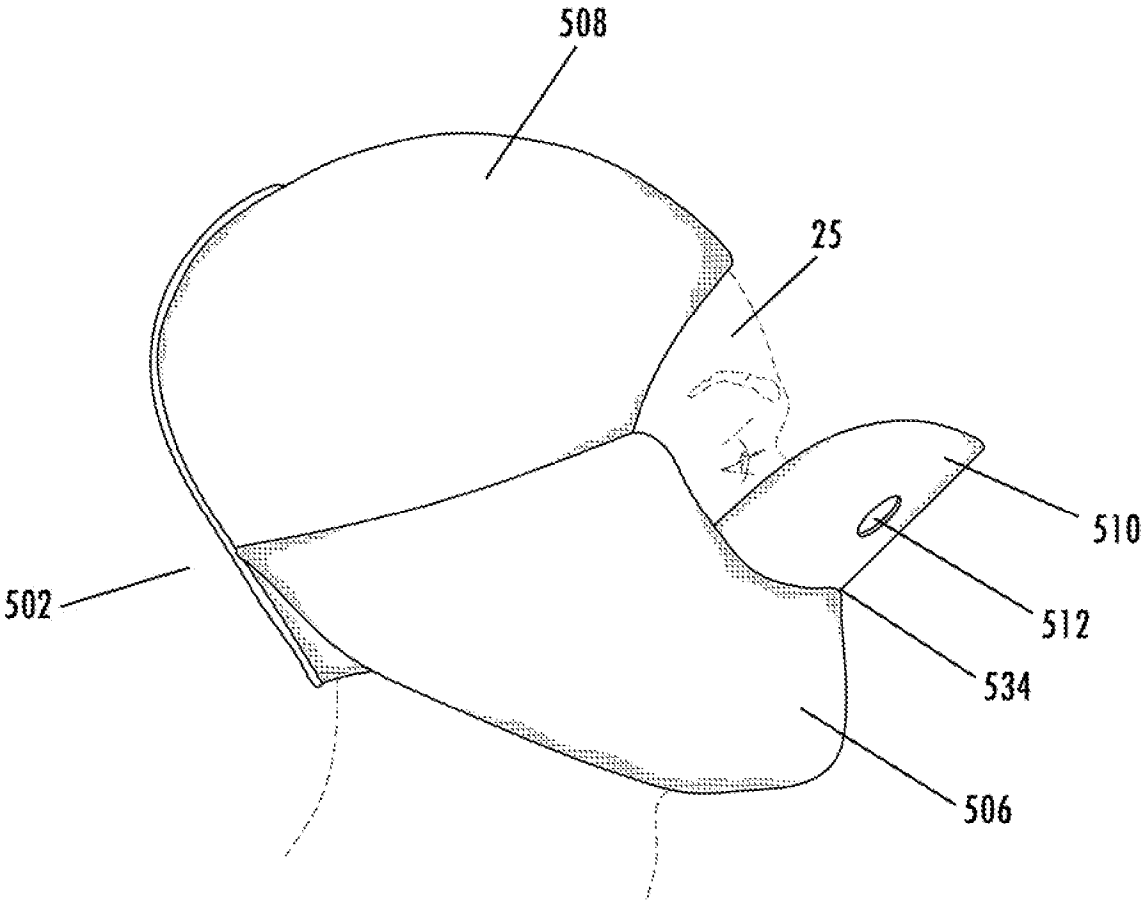
FIG. 25 is a side view of the embodiment of FIG. 19 converted to use as a face covering with the bill of the embodiment positioned as a face shield.

FIGS. 19-26 disclose a fifth embodiment of the invention. Garment 502 may configure as a double layered cap, or it may be configured with one layer of the garment 502 being convertible to a face shield (FIGS. 22-23) or a hunter's face cover (FIG. 25).

Referring specifically again to FIG. 19, garment 502 comprises a first panel 506 which can be arranged to overlie a cap member 508. First panel 506 and cap member 508 are each constructed of fabric, preferably cotton, fleece, wool or synthetic versions thereof. A bill element 510 is attached at the second edge 534 of garment 502 and bill element 510 may be manipulated from a position between first panel 506 and cap member 508 and may extend outward to shield the user's face 5 from overhead sunlight. Bill element 510 is provided with at least one, and preferably two spaced apart view openings 512 therethrough, the openings 512 being spaced apart about the same distance as the separation of a typical user's eyes. Openings 512 provide observation holes for the user. Bill element 510 is preferably of stiffer fabric than first panel 506 and cap member 508 but nonetheless must flex somewhat. Bill element 510 may alternatively be constructed of a mesh fabric which the user can see through, or with mesh inserts in the bill element 510 in place of the openings 512. Bill element 510 may be made of stitched together layers of fabrics and stiffeners but must remain flexible enough to generally conform to the forehead of the user or to the mouth area of the user, when the garment is configured as a face cover.

First panel 506 is preferably flexible to conform to the shape of a user's scalp when positioned overlying cap member 508. As a result, first distal region 520 and second distal region 522 are capable of becoming concave to conform to the user's head.

First panel 506 wraps about the user's head overlying cap member 508 and is attached thereto along lateral seams 512, 514 such that first panel 506 can rotate around seams 512, 514 after detachment of rear corners 538, 538*a* from each other.

First panel 506 includes a first edge 524 comprising first and second segments 526, 528. A gap 560 may remain between first segment 526 and second segment 528 when rear corners 538, 538*a* are selectively joined by hook and loop fasteners or other selectively detachable closure elements attached to first panel 506 on opposing faces of first panel 506 at corners 538, 538*a*.

Figure 19:
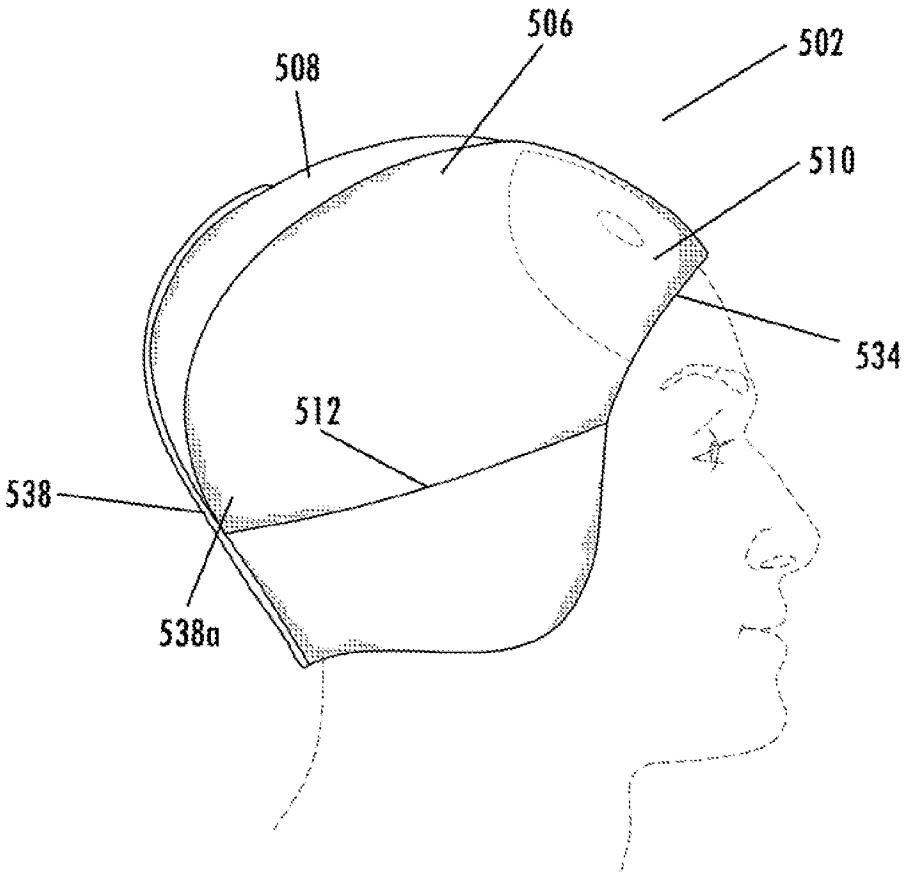
FIG. 19 is a side view of a fifth embodiment of the garment invention shown in use as a cap on the head of a user with the bill of the embodiment folded underneath the outer layer of the embodiment.
Figure 20:
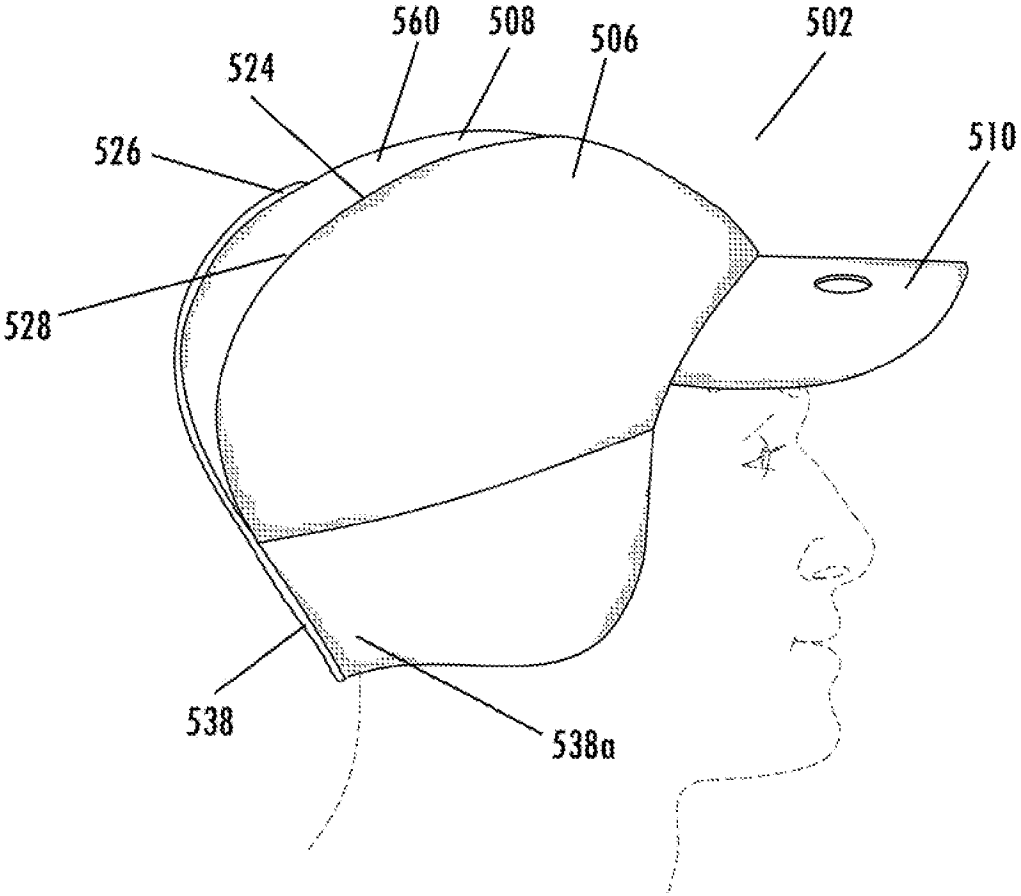
FIG. 20 is a side view of the embodiment of FIG. 19 with the bill element exposed and in place to serve as the bill of a cap.
Figure 21:
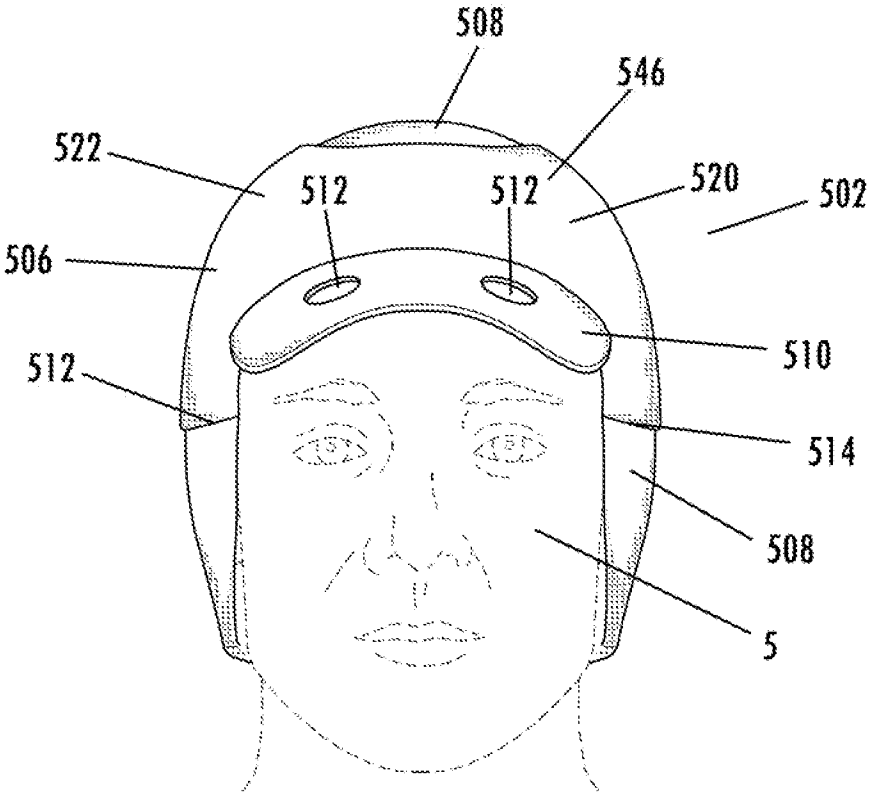
FIG. 21 is a front view of the embodiment of FIG. 19 being worn on the head of a user.
Figure 22:
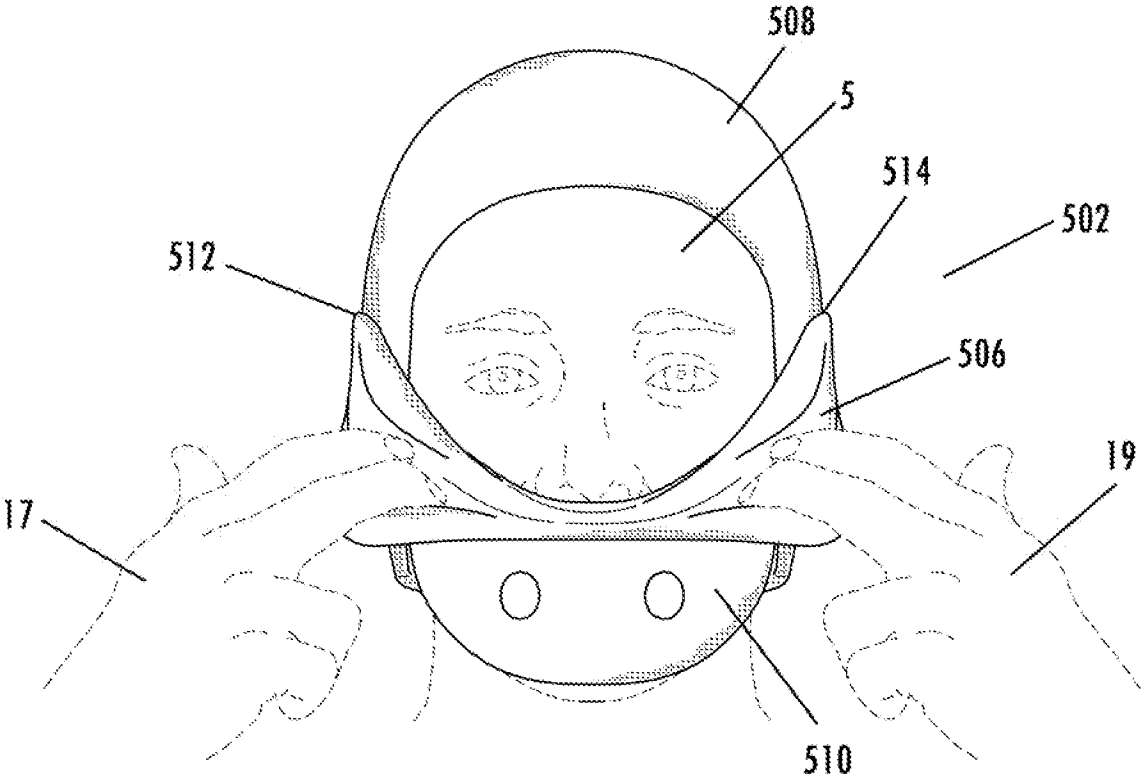
FIG. 22 is a front view of a user of the embodiment of FIG. 19 converting the invention from use as a headgear to use as a face covering.

In FIG. 22, it can be seen that first panel 506 is being manipulated from its cap configuration seen in FIGS. 19-21 to the face shield position shown in FIG. 23. The user may employ his or her hands 17, 19 to pull first panel 506 downward, rotating first panel about seams 512, 514 while cap element 508 of garment 502 stays in place on the user's head. It is seen that bill element 510 is positioned between first panel 506 and the user's face 5 during this maneuver.

FIG. 23 illustrates the configuration of garment 502 as a cap with attached face shield, the cap element 508 remaining in place on the user's head with the first panel 506 overlying the user's mouth and jaw. In this configuration, the corners 538, 538*a* (See. FIG. 20) have been rejoined at the rear of the user's neck after the first panel 506 is in place covering the lower part of the user's face. Bill element 510 is hidden below first panel 506 and overlies the user's lower face and mouth area. This position of bill element 510 reduces the amount of moisture likely to collect in the part of the fabric body 546 overlying the user's face.

FIG. 24 reveals that cap element 508 also comprises a fabric panel 546 having a first edge 550 and an opposing second edge 548. First edge is divided into first segment 552 and second segment 554 which are drawn together where opposing first corners 556, 558 are joined by detachable fasteners such as a hook and loop fastener pair.

FIG. 25 illustrates a further configuration of garment 502 for use by a deer hunter or other user who desires to shield his upper face from observation from below. In this variation of the configuration of FIG. 24, bill element 510 has been manipulated from under first panel 506 to extend from second edge 534, the bill element 510 extending upward somewhat by its curvature and its attachment to second edge 534.

Openings 512 through bill element 510 permit the user to see his surroundings below and forward of his face. A hunter using the garment 502 therefore has a head covering in cap element 508 and an attached face shield in first panel 506, as well as a manner of obscuring his eyes and upper face 25 from view of deer or other wary game moving about below the elevation of the user.

FIG. 26 illustrates a sixth embodiment of the garment 602 configured as a hand warmer. Garment 602 comprises a two layer fabric body 646 having a first layer 606 and a second layer 608, with each layer 606, 608 of approximately equal area and shape, and with first edge 624 common to both first and second layer 606, 608. Similarly, first and second layer 606, 608 are joined at second edge 634 of fabric body 646. First edge 624 of fabric body 646 comprises first and second segments 626, 628 which can be selectively joined by fasteners 630 and 632 when fabric panel 646 is formed into a cap configuration.

Opposing side edges 640, 642 include hand openings 638 formed by the detached opposing side edges 640, 642 of first layer 606 and second layer 608. The user may insert his or her hands into the hand openings 638 for insulation of the hands from cold temperatures.

Garment 602 features a flexible transparent window 650 in first layer 606 which allows the user to observe a handheld mobile electronic device 33 held by the user and located within garment 602. Window 650 provides a user a way to utilize a mobile device while attending outdoor sporting events or otherwise in a cold environment. Yet, garment 602 can be converted to a headgear by bringing first segment 626 of first edge 624 alongside or overlapping second segment 628 and retaining them together through use of fasteners 630, 632. When so connected, garment 602 may be worn with second edge 634 framing the user's face and opposing side edges 640, 642 extending along the side of the neck of the user.

In lieu of window 650, a gap in the first layer 606 or a flap covered opening might be provided so that a mobile device 33 held by a user whose hands are placed in the hand openings 638 may be observed as desired, while not requiring the user to remove his/her hands from the hand openings 638.

FIG. 27 illustrates a further alternative embodiment of garment 702 wherein first fabric panel 706 overlies and is joined to second fabric panel 708 at first edge 724 and second edge 734. Thumb openings 750, 752 pass through first fabric panel 706 so that a portable mobile device 33 can be operated by the user whose hands are inserted in the hand openings 738 on opposing side edges 740, 742. With this embodiment, the mobile device 33 remains outside garment 702. Optional flaps or other covers for thumb openings 750, 752 may also be provided or hook and loop fasteners may be employed to draw openings 750, 752 into a closed position when the user does not desire to use his or her thumbs to operate a mobile device.

As with the sixth embodiment garment 602 of FIG. 26, garment 702 may be folded such that first segment 726 of first edge 724 may be engaged with second segment 728 and detachably fastened thereto by hook and loop fasteners 730, 732. The garment 702 may then be employed as a cap with the second edge 734 framing the face and opposing side edges 740, 742 forming a rear edge of the cap.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

The invention claimed is:

1. A garment comprising a fabric body comprising at least four edges, the fabric bed comprising a first portion and an adjoining second portion, the first portion and the second portion being approximately equal in area, each of the first portion and the second portion being concave, a first of the at least four edges comprising a first segment and an adjoining second segment, the first segment of the first edge being a part of the first portion of the fabric body and the second segment of the first edge being a part of the second portion of the fabric body, the first segment and the second segment of the first edge being substantially similar in length, a second of the at least four edges disposed opposite the first edge, a free side edge interconnecting each of opposing ends of the first edge and the second edge, at least one closure element associated with the first edge, the at least one closure element selectively detachably retaining at least a portion of the first segment of the first edge to at least a portion of the second segment of the first edge, wherein the garment may conform to a curvature of a head of a user when the at least a portion of the first segment of the first edge of the fabric body is retained to the at least a portion of the second segment of the first edge, and wherein the garment may be alternatively be configured as a face covering, and wherein the garment may further be alternatively configured as a hand warmer.

2. The garment of claim 1 wherein the fabric body comprises first layer and a second layer, the first and second layers joined at the first edge and at the second edge of the fabric body, a hand opening provided in each of the side edges of the fabric body, wherein a user may insert the user's hands into the hand openings when the first segment is detached from the second segment.

3. The garment of claim 2 wherein a window element is provided in a first of the layers, wherein a mobile device held between the first and second layers by the user may be viewed by the user.

4. The garment of claim 1 wherein the closure element is a hook and loop fastener set, a first element of the hook and loop fastener set attached to the first portion of the fabric body adjacent the first segment of the first edge and a second element of the hook and loop fastener set attached to the second portion of the fabric body adjacent the second segment of the first edge.

5. The garment of claim 1 wherein the closure element comprises a series of lace openings disposed along each of the first and the second segments of the first edge of the fabric body, at least a first lacing inserted through the lace openings, the at least a first lacing passing from the lace openings of the first segment into the lace openings of the second segment, the first segment of the first edge drawn toward the second segment of the first edge when tension is exerted on free ends of the lacing.

6. The garment of claim 1 wherein the closure element comprises a series of lace openings disposed along each of the first and the second segments of the first edge of the fabric body, a plurality of laces inserted through adjoining ones of the lace openings wherein each lace passes from a one of the lace openings of the first segment into a one of the lace openings of the second segment, each of the laces having opposing free ends, the free edge of the first segment of the first edge drawn toward the free edge of the second segment of the first edge when tension is exerted on free ends of the laces.

7. The garment of claim 1 wherein a semi-rigid bill element is coupled to the second edge of the fabric body, the bill element selectively configurable to fold about the second edge into an abutting relationship with a first surface of the fabric body, the bill element further selectively configurable to extend from a forehead of a user wearing the garment.

8. The garment of claim 7 wherein the bill element selectively extends from the face of the user when the fabric body is configured as a cover for the user's face, the bill element further disposable into abutment between the fabric body and a mouth area of the user.

9. The garment of claim 7 wherein the bill element includes at least one opening therethrough, whereby the user may look through the at least one opening.

10. The garment of claim 7 wherein the bill element includes two spaced apart openings therethrough, the openings spaced apart about the distance between eyes of the user, whereby the user may selectively look through the openings.

11. The garment of claim 7 wherein the bill element includes at least a central mesh, the mesh permitting observation by the user through the bill element.

12. A garment comprising a fabric body comprising at least a first edge, an opposing second edge, and a pair of side edges, the fabric body further comprising a central region disposed between the side edges of the fabric body, the fabric body further including distal regions, each of the distal regions extending from the central region to a one of the side edges of the fabric body, the central region of the fabric body narrower than either of the distal regions of the fabric body, a first of the four edges comprising a first edge half and a second edge half, the first edge half of the first of the four edges joining the second edge half thereof at a center, at least a first closure element selectively retaining at least a part of the first edge half to at least a part of the second edge half.

13. The garment of claim 12 wherein the fabric body comprises a first layer and a second layer, the first and second layers joined at the first side and at the second side of the fabric body, hand openings provided in the side edges of the fabric body.

14. The garment of claim 12 wherein a window element is provided through a one of the layers, wherein a mobile device located between the first layer and the second layer may be observed by a user whose hands are inserted in the hand openings and hold the mobile device.

15. The garment of claim 12 wherein a view opening is provided through a one of the layers, wherein a mobile device located between the first layer and the second layer may be observed by a user whose hands are inserted in the hand openings and hold the mobile device.

16. The garment of claim 12 wherein at least two spaced apart thumb holes provided through a one of the layers of the fabric body, wherein a user who has placed his or her hands between the first and second layers may selectively pass the user's thumbs through selected ones of the thumb holes, wherein a mobile device adjacent to the one of the layers may be manipulated by the thumbs of the user.

17. The garment of claim 12 wherein the closure element is a mating pair of fastening elements, a first element of the mating pair of fastening elements attached to the fabric body adjacent the first edge half of the first edge and a second element of the mating pair of fastening elements attached adjacent the second edge half of the first edge, wherein the first edge half and the second edge half are selectively joined when the first element of the mating pair of fastening elements is mated with the second element thereof, wherein the garment may be used as a head covering.

18. The garment of claim 12 wherein the closure element is a hook and loop fastener set, a first element of the hook and loop fastener set attached adjacent the first edge half of the first side and a second element of the hook and loop fastener set attached adjacent the second edge half of the first edge, whereby the first edge half and the second edge half are selectively joined by the hook and loop fastener set.

19. The garment of claim 12 wherein the closure element comprises a series of lace openings disposed along each of the free edges of the first and the second half of the first side of the fabric body, a plurality of laces inserted in adjoining ones of the lace openings, each of the laces having opposing free ends, the free edge of the first edge half of the first side drawn toward the free edge of the second half of the first side when tension is exerted on the free ends of the laces.

20. A convertible garment comprising a fabric body comprising four edges, a first edge of the fabric body including at least two clip members coupled thereto, the clip members being spaced apart approximately the width of a bill of a baseball cap, a second of the four edges opposing the first edge, the second of the four edges having a first half edge and a second half edge, the first half edge detachably attachable to the second half edge, wherein the fabric body may be placed over a cap being worn by a user when the first half edge is detachably retained to the second half edge, and wherein the clip members may be detachably attached to opposing sides of a bill of a the cap being worn by the user.

21. A garment for a user's head comprising an elongate fabric body comprising a first distal region and a second opposing distal region, each of the first distal region and the second distal region being concave to conform to a curvature of the user's head, the elongate fabric body further comprising a center region disposed between the first and second distal regions, the center region of the elongate fabric body narrower than either of the distal regions of the elongate fabric body, at least a portion of an edge of the first distal region selectively retainable to at least a portion of an edge of the second distal region, wherein the elongate fabric body may be worn as a head cover for the head of the user when the first distal region is selectively retained to the second distal region.

* * * * *